US007517269B2

(12) United States Patent
Cyrus et al.

(10) Patent No.: US 7,517,269 B2
(45) Date of Patent: Apr. 14, 2009

(54) BUILDING ELEMENT FOR CONSTRUCTING A MODULAR SUBSTRUCTURE

(75) Inventors: Peter Cyrus, Seattle, WA (US); Philip N. Carter, Langley (CA); Bradley Ryan Madu, Langley (CA)

(73) Assignee: Parvia Corp., Seattle, WA (US)

( * ) Notice: Subject to any disclaimer, the term of this patent is extended or adjusted under 35 U.S.C. 154(b) by 38 days.

(21) Appl. No.: 10/639,606

(22) Filed: Aug. 12, 2003

(65) Prior Publication Data

US 2005/0048867 A1 Mar. 3, 2005

(51) Int. Cl.
*A63H 33/06* (2006.01)

(52) U.S. Cl. ..... 446/118; 446/124; 446/108

(58) Field of Classification Search ..... 446/124, 446/108–115, 117, 118, 122, 476, 478, 85; 434/72, 74; 52/586.1, 586.2, 391, 79.1, 79.2, 52/79.3

See application file for complete search history.

(56) References Cited

U.S. PATENT DOCUMENTS

| | | | | | |
|---|---|---|---|---|---|
| 2,988,844 | A | * | 6/1961 | Frimberger | 446/115 |
| 3,570,170 | A | | 3/1971 | Yoshihiro | |
| 3,600,844 | A | * | 8/1971 | Simpson | 446/118 |
| 4,148,152 | A | | 4/1979 | Barlow | |
| 4,306,372 | A | * | 12/1981 | Lin | 446/109 |
| 5,348,478 | A | * | 9/1994 | Bradshaw | 434/150 |
| 5,545,070 | A | * | 8/1996 | Liu | 446/104 |
| 5,645,463 | A | * | 7/1997 | Olsen | 446/104 |
| 5,775,046 | A | * | 7/1998 | Fanger et al. | 52/590.1 |
| 5,810,639 | A | | 9/1998 | Liu | |
| 5,848,926 | A | * | 12/1998 | Jardetzky et al. | 446/85 |
| 5,961,364 | A | * | 10/1999 | Bach et al. | 446/110 |
| 6,050,044 | A | * | 4/2000 | McIntosh | 52/591.1 |
| 6,086,444 | A | * | 7/2000 | Glickman | 446/124 |
| 6,746,297 | B2 | * | 6/2004 | Robjent et al. | 446/108 |
| 7,229,334 | B2 | * | 6/2007 | Ishikawa | 446/91 |

FOREIGN PATENT DOCUMENTS

| | | | |
|---|---|---|---|
| CA | 2337238 | | 2/2000 |
| CA | 2288383 | A1 | 3/2000 |
| CA | 2361993 | | 4/2003 |
| GB | 365369 | | 1/1932 |
| GB | 673857 | | 6/1952 |
| JP | 4939594 | | 10/1974 |
| JP | 4941435 | | 11/1974 |
| WO | 9916037 | A1 | 4/1999 |
| WO | 9939795 | A1 | 8/1999 |
| WO | 02055170 | A1 | 7/2002 |

OTHER PUBLICATIONS

Notice of Grounds for Rejection (JP) dated Nov. 18, 2008, issued in corresponding Japanese Application No. 2006-523321.

* cited by examiner

*Primary Examiner*—Dana Ross
*Assistant Examiner*—Jamila Williams
(74) *Attorney, Agent, or Firm*—Christensen O'Connor Johnson Kindness PLLC

(57) ABSTRACT

A building element suitable for use in supporting model building sets. The building element is configured to be removably secured to a plurality of like or similar building elements to form a modular substructure for supporting model building sets. To that end, the building element may include a plurality of connector fitting arrangements disposed on the surfaces of the building element. In one embodiment, the building element is configured to be separable into half-sections and quarter-sections.

34 Claims, 23 Drawing Sheets

BUILDING ELEMENT FOR CONSTRUCTING A MODULAR SUBSTRUCTURE

FIELD OF THE INVENTION

The present invention relates to modular substructures for model building sets, and more particularly, to building elements suitable for constructing modular substructures for supporting model building sets.

BACKGROUND OF THE INVENTION

Miniature models of towns and buildings, such as model building sets, have been around for many years. Such model building sets offer educational opportunities to children as well as providing entertainment to both children and adult enthusiasts alike. Conventional model building sets, typically include connectable modular components. One such conventional model building set is shown in FIG. 1 and described in U.S. Pat. No. 5,951,356, which is presently assigned to Parvia Corporation, of Seattle, Wash., and hereby incorporated by reference.

Referring now to FIG. 1, an exploded view of a conventional modular model building set 20 is shown. The modular model building set 20 generally includes a modular substructure 24, a terrain 28, and playing components 30. As assembled, the modular substructure 24 supports, and is removably attachable to, the terrain 28. In turn, the terrain 28 supports, and is removably attachable to the playing components 30. The modular aspects of the substructure 24, terrain 28, and the playing components 30 allow a multitude of different configurations to be created from the modular model building set 20 while employing the same elements of the substructure 24, terrain 28, and the playing components 30.

SUMMARY OF THE INVENTION

In accordance with one embodiment of the present invention, a building element is provided. The building element includes a body, wherein the body is configured for cooperating with another similar building element positioned below and aligned therewith such that the building elements are connectable in a secure, removable vertical stacking configuration. The body is configured for cooperating with another similar building element positioned below and inverted with respect to the building element and aligned therewith such that the building elements are connectable in a secure, removable inverted vertical stacking configuration. The body is also configured for cooperating with a portion of another similar building element positioned above and offset therewith such that the building elements are connectable in a secure, removable vertical offset stacking configuration. The body is further configured to be interlocked with another similar building element in a secure, removable manner.

In accordance with another embodiment of the present invention, a stackable building element adapted to be stacked in multiple-level configurations is provided. The building element is comprised of a body that includes a plurality of first connector fitting adapted to receive cooperating connector fittings of another building element. The building element also includes a plurality of second connector fittings arranged and configured for cooperating with the first connector fittings of another building element positioned below and aligned therewith for allowing a secure, removable vertical stacking configuration of a plurality of building elements. The plurality of second connector fittings are further arranged and configured for cooperating with second connector fittings of another building element positioned below and inverted with respect to the building element and aligned therewith for allowing a secure, removable inverted vertical stacking configuration of two building elements.

In accordance with yet another embodiment of the present invention, a stackable building element adapted to be stacked in multiple-level configurations is provided. The building element includes a rectangular base plate having an inner surface and an outer surface, a plurality of side walls extending outwardly substantially orthogonal from the inner surface of the base plate and having outer ends, and a plurality of first connector fittings positioned around the periphery of the base plate outer surface. The first connector fittings are adapted to receive cooperating connector fittings of another building element. The building element also includes a plurality of second connector fittings positioned at the side wall outer ends. The second connector fittings are arranged and configured for cooperating with the first connector fittings of another building element positioned below and aligned therewith for allowing a secure, removable vertical stacking configuration of a plurality of building elements. The plurality of second connector fittings are further arranged and configured for cooperating with second connector fittings of another building element positioned below, inverted such that the side wall outer ends of the building elements are juxtaposed, and aligned therewith for allowing a secure, removable inverted vertical stacking configuration of two building elements.

In accordance with still another embodiment of the present invention, a building element adapted to be separated into half-sections or quarter-sections is provided. The building element includes a rectangular base plate having an inner and outer surfaces and lateral bisecting planes and a plurality of side walls extending outwardly substantially orthogonal from the inner surface of the base plate. The side walls are contiguously connected and have outer ends. The building element also includes a plurality of connector fittings positioned on the base plate outer surface and the side wall outer ends. The connector fittings are adapted to be removably secured to cooperating connector fittings of another structure. The building element further includes a set of first joints positioned along the lateral bisecting planes of the base plate. The joints are configured for decoupling the base plate into separate sections. Each side wall includes a second joint configured for decoupling each side wall into separate side wall sections.

In accordance with yet another embodiment of the present invention, a building element adapted to be separated into half-sections or quarter-sections, is provided. The building element includes a rectangular base plate having inner and outer surfaces and lateral bisecting planes and a plurality of side walls extending outwardly substantially orthogonal from the inner planar surface of the base plate. The side walls are contiguously connected and have outer ends. The building element also includes a plurality of connector fittings positioned on the base plate outer surface and the side wall outer ends. The connector fittings are adapted to be removably secured to cooperating connector fittings of another structure. The building element further includes first means for decoupling the side walls at a location that is in substantial alignment with the bisecting planes of the building element, and second means for decoupling the base plate along its bisecting planes so that the building element may be separated into individual sections.

In accordance with still another embodiment of the present invention, a modular substructure is provided. The modular substructure includes a first building element including a polygonal base having first and second opposed planar surfaces and a plurality of contiguously connected side walls extending from one of the surfaces, thereby defining a first cavity. The modular substructure also includes a second building element including a polygonal base having first and second opposed planar surfaces and a plurality of contiguously connected side walls extending from one of the surfaces, thereby defining a second cavity. A portion of each first and second building element is interconnected with the second and first building elements, respectively, such that the second planar surface of the first building element is substantially parallel to second planar surface of the second building element, at least one side wall of the first building element interfaces with at least one side wall of the second building element, and the portions of the first and second building elements occupy a portion of the second and first cavities, respectively.

In accordance with still yet another embodiment of the present invention, a method of constructing an interconnected, modular substructure is provided. The method includes obtaining first, second, third, fourth, and fifth substantially identical building elements. Each building element includes a rectangular base plate having inner and outer surfaces and lateral edges, a plurality of side walls extending outwardly substantially orthogonal from the inner surface of the base plate, and a plurality of connector fittings disposed on the inner surface of the base plate and the side wall outer ends. The building elements are configured so as to be separable into half-sections and quarter-sections each having a portion of the plurality of connector fittings. The first, second, third, and fourth substantially identical building elements are arranged in abutting relationship as a 2×2 array. Each respective building element is oriented so that the side walls of the building elements extend in the same direction. The fifth building element is placed in an inverted manner with respect to the first through fourth building element in the center of the 2×2 array so that at least one connector fitting of each of the first, second, third, and fourth building element cooperatively engage with at least one connector fitting of the fifth building element in a removably secure manner.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

The present invention will now be described with reference to the accompanying drawings where like numerals correspond to like elements. The present invention is directed to a building element suitable for use in supporting model building sets. Specifically, the present invention is directed to a building element configured to be removably secured to a plurality of like or similar building elements to form a modular substructure suitable for supporting model building sets. While the building elements and the resulting modular substructures of the present invention have their primary application in supporting model building sets, it will be appreciated that the building elements and the modular substructures of the present invention may be used in other applications desiring a modular system for forming rigid substructures or foundations. Thus, the following description relating to modular substructures for use with model building sets is meant to be illustrative and not limiting the broadest scope of the inventions, as claimed. Additionally, although illustrative terms such as vertical, horizontal, upper, lower, top, bottom, left and right may be used herein, they are descriptive in nature and should not be construed as limiting.

Figure 1:
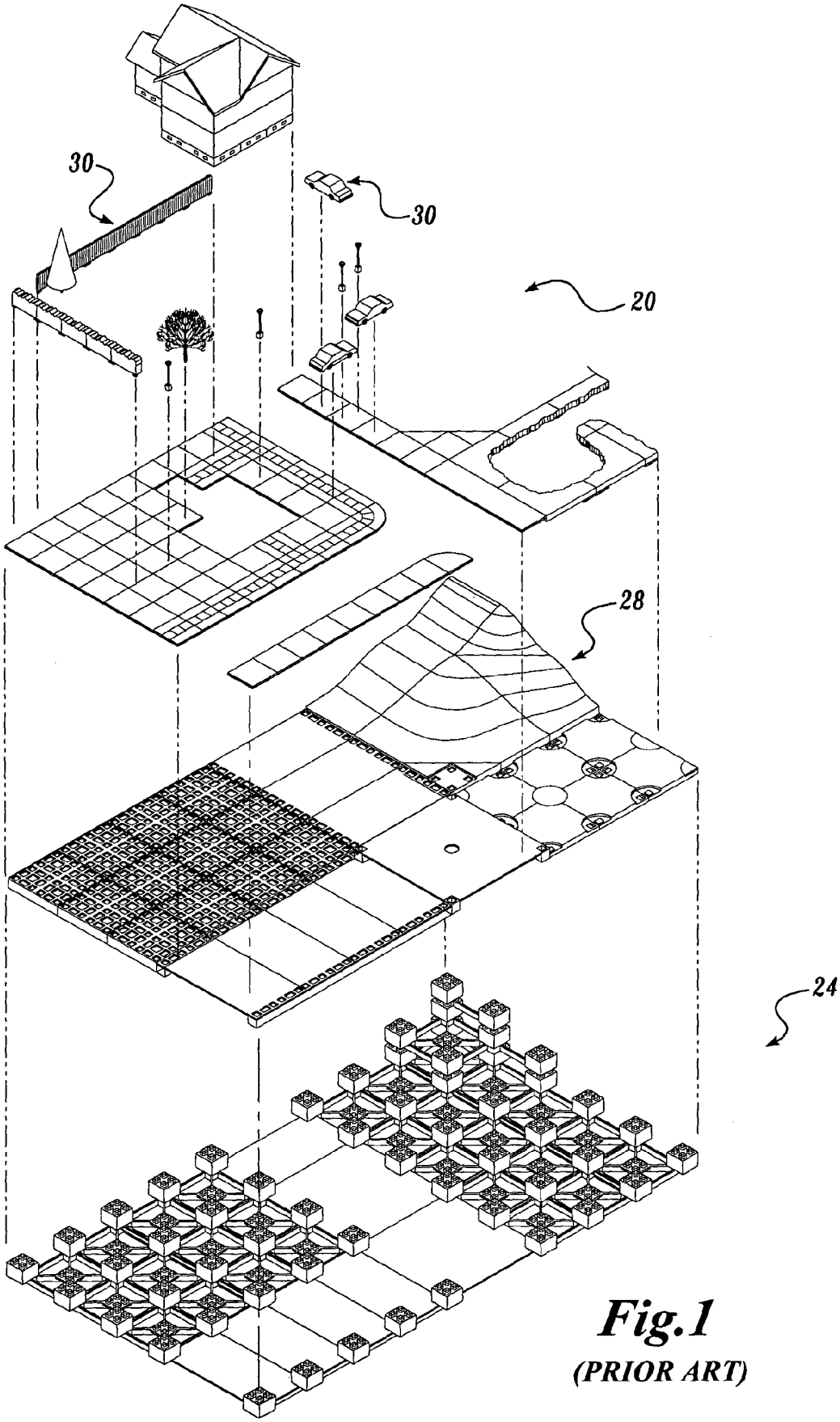
Fig.1 (PRIOR ART)
FIG. 1 is an exploded perspective view of a conventional modular model building set.
Figure 2A:
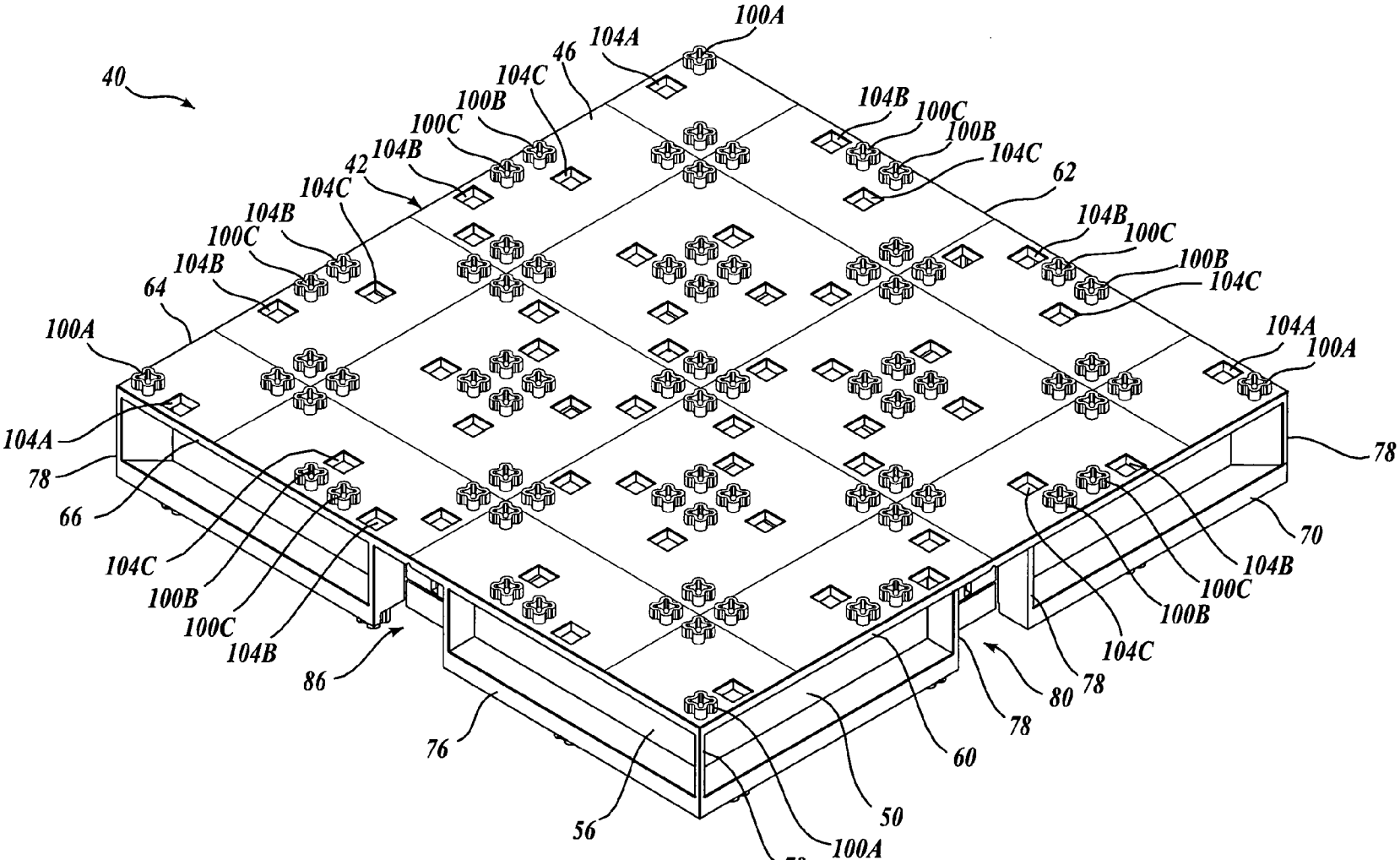
FIGS. 2A and 2B are perspective views of one embodiment of a building element formed in accordance with the present invention.
Figure 2B:
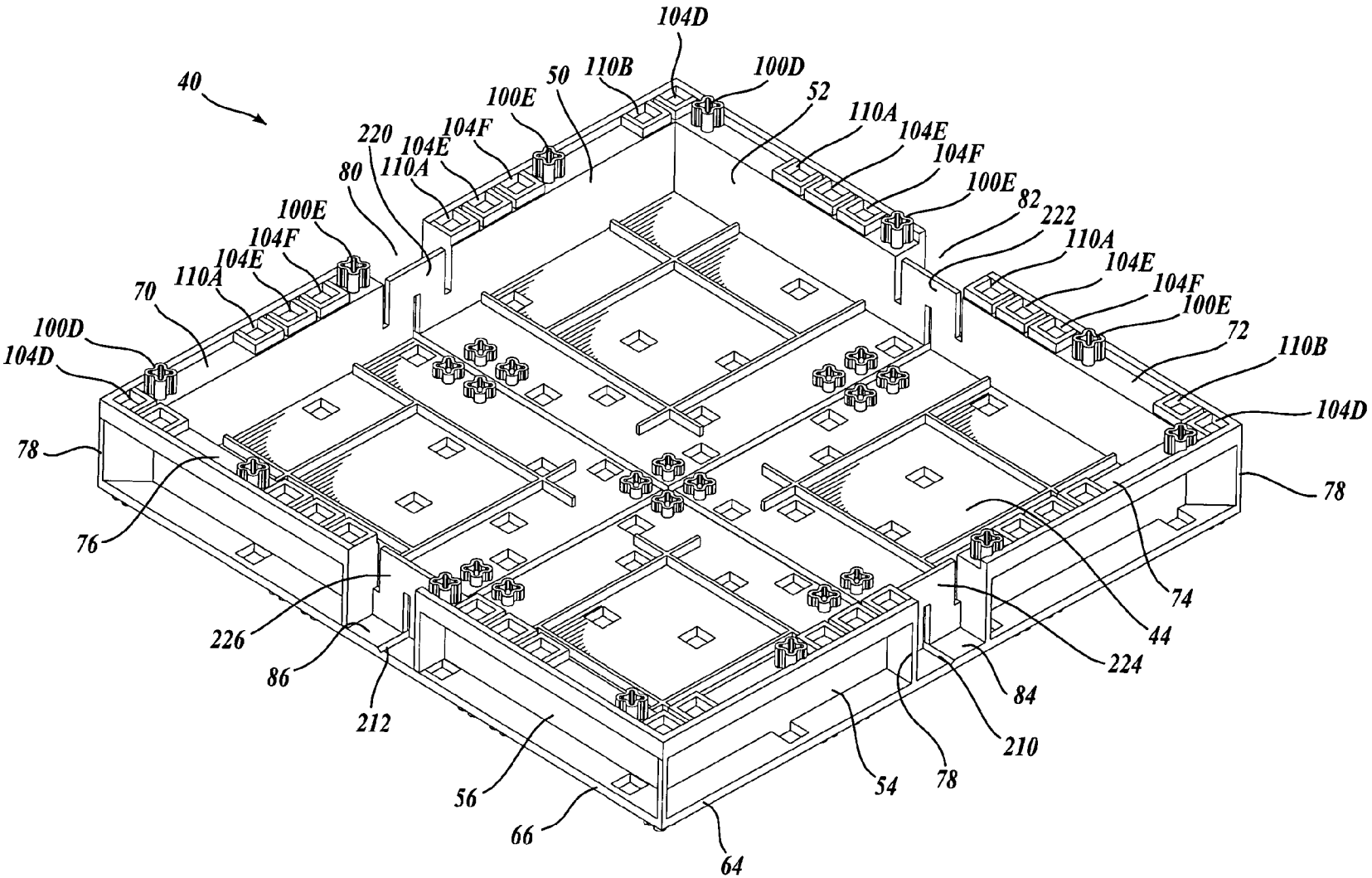

Referring now to FIGS. 2A and 2B, top and bottom perspective views of one embodiment of a building element 40 formed in accordance with the present invention are shown. The building element 40 of FIGS. 2A-2B is suitable for use in constructing a modular substructure suitable for replacing the substructure 24 shown in FIG. 1. As will be described in more detail below, a plurality of building elements 40 may be joined together to form a modular substructure, such as a foundation, or other stacked or assembled structures for use in many applications, including model building sets. In one embodiment of the present invention, a plurality of building elements 40 may be joined in a unique manner to form a substantially rigid foundation truss, as will be described in more detail below. The building element 40 is preferably constructed of a synthetic polymer such as acrylonitrilebutadiene styrene (ABS), which may be extruded or injection molded using techniques known in the art.

As best shown in FIGS. 2A and 2B, the building element 40 includes a polygonal shaped base section or plate 42, preferably square, having inner and outer planar surfaces 44 and 46. The building element 40 further includes side walls 50, 52, 54, and 56 (side walls 52 and 54 are hidden in FIG. 2A) spaced inward a distance from the outer edges of the base plate 42 and extending orthogonally from the inner surface 44 of the base plate 42. As such, due to the inward placement of the side walls 50, 52, 54, and 56, contiguous flange sections 60, 62, 64, and 66 are created out of the perimeter of the base plate 42. The building element, therefore, forms a rectangular body having an open-ended cavity.

As best shown in FIG. 2B, at the outermost ends of the side walls 50, 52, 54, and 56, there are formed side wall flange sections 70, 72, 74, and 76 that extend outward from the side walls substantially parallel with the base plate flange sections 60, 62, 64, and 66, respectively (base plate flange sections 60 and 62 are hidden in FIG. 2B). The side wall flange sections 70, 72, 74, and 76 extend outward a selected distance so as to be flush with the base plate flange sections 60, 62, 64, and 66. Support members 78 positioned in-between the base plate flange sections 60, 62, 64, and 66 and the side wall flange sections 70, 72, 74, and 76 may be provided to augment the rigidity and strength of the building element 40.

In the embodiments shown in the FIGURES, the side wall flanges 70, 72, 74, and 76 are not contiguous around the perimeter of the side walls, but include gaps 80, 82, 84, 86 located at the mid-span of each side wall 50, 52, 54, and 56, respectively. However, it will be appreciated that in other embodiments, the flange sections may be contiguously formed or connected, if desired. Additionally, it will be appreciated that the side walls 50, 52, 54, and 56 may extend from the outer edges of the base plate 42 with the side wall flanges 70, 72, 74, and 76 extending inward therefrom. Alternatively, the flanges may be omitted and replaced by side walls of suitable thickness, if desired.

As was briefly described above, in accordance with aspects of the present invention, the building element 40 may be configured to be removably secured to like or similar building elements, or other components of the model building set. To be able to be removably secured to such components, the building element 40 includes a plurality of connector fittings, including male and female connector fittings, positioned on, in, or through various surfaces of the building element 40. The cooperating male and female connector fittings allow the building element 40 to be removably secured to other building elements 40 or other components of the model building set having cooperating connector fittings. In various embodiments of the present invention, the building element 40 may include a plurality of connector fitting arrangements or any combination of a plurality of connector fitting arrangements for allowing the building element to be removably secured to other structures in multiple configurations. A description of a few suitable connector fitting arrangements and the placement of the connector fittings in such arrangements will now be described in detail.

Figure 4A:
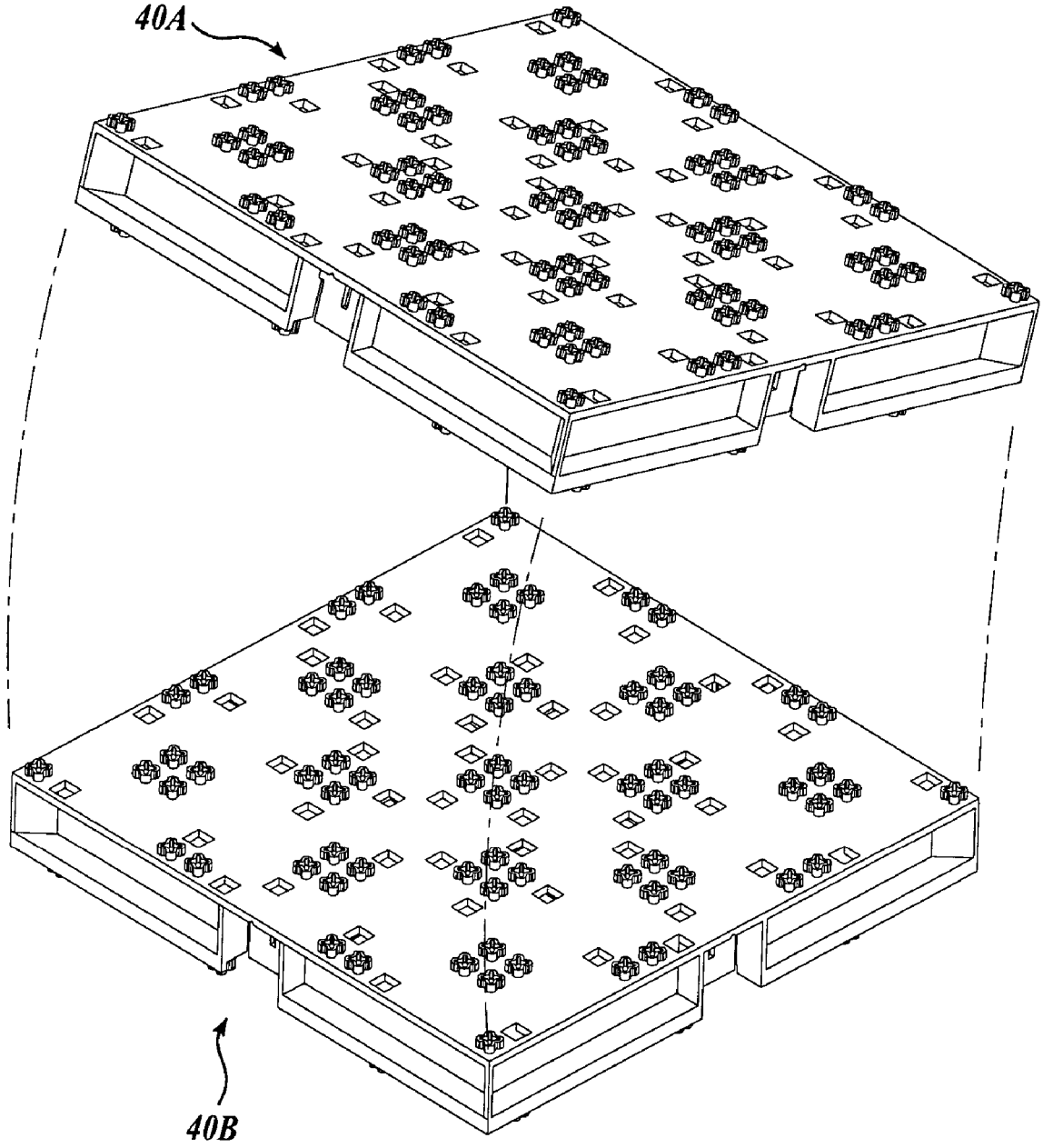
FIGS. 4A and 4B are perspective views of two building elements depicting a vertical stacking configuration in accordance with the present invention.
Figure 4B:
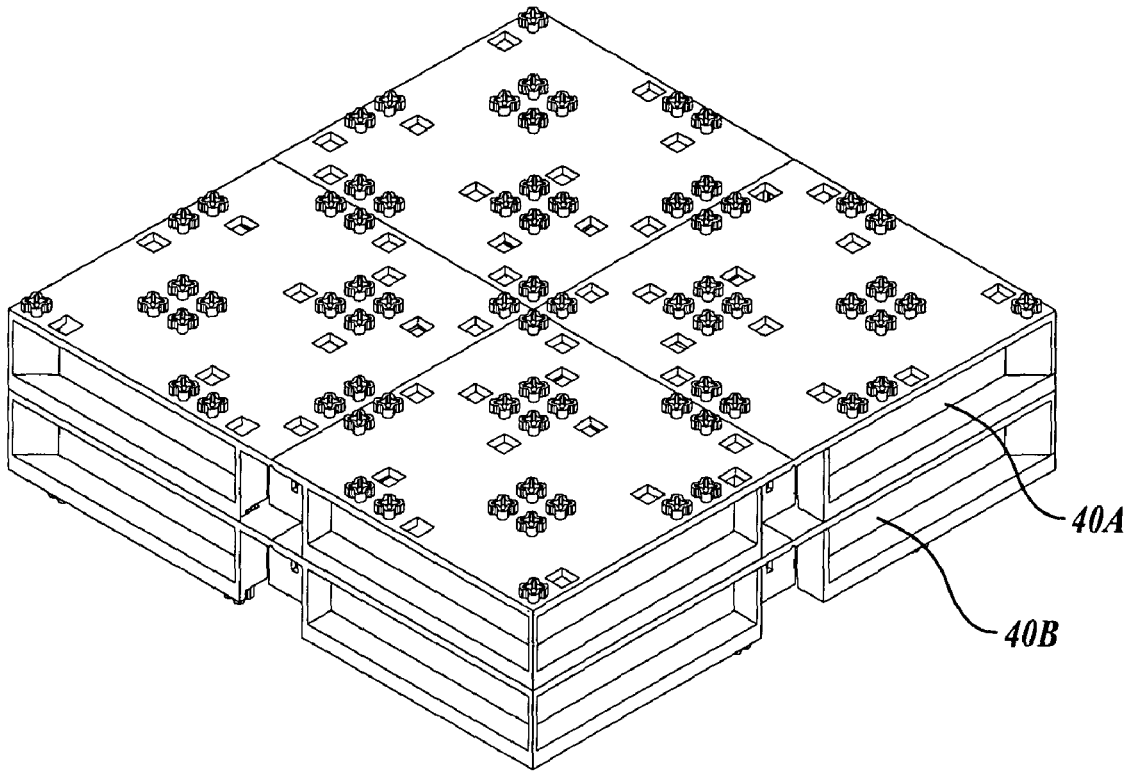

FIGS. 4A and 4B are perspective views of two building elements 40A-40B depicting a vertical stacking configuration in accordance with the present invention. The vertical stacking configuration allows for variation in the height of the modular substructure and provides an efficient and space saving configuration for storing multiple building elements. To achieve the vertical stacking configuration shown in FIGS. 4A and 4B, the building element 40 includes a first connector fitting arrangement, which will now be described in detail.

As best shown in FIG. 2A, the first connector fitting arrangement includes a plurality of male connector fittings, generally designated 100, located on the outer surface 46 of the base plate 42 along the base plate flange sections 60, 62, 64, 66 and projecting substantially orthogonal therefrom. The first connector fitting arrangement further includes a plurality of female connector fittings, generally designated 104, disposed adjacent to the male fittings 100. In the embodiment shown, male connector fittings 100A are formed at each corner of the outer surface of the base plate 42 and in pairs of connector fittings 100B and 100C spaced approximately evenly along the flange sections 60, 62, 64, and 66. Female connector fittings 104A are located adjacent the male connector fittings 100A, female connector fittings 104B are located adjacent and aligned with male connector fitting 100C opposite male fitting 100B, and female connector fittings 104C are spaced inward from and aligned with male connector fittings 100B, respectively. As such, as shown best in FIG. 2A, the pattern of connector fittings and spacings between connector fittings arrange on the base plate flange section 60 is repeated for the base plate flange sections 62, 64, 66 in a head-to-toe relationship around the perimeter of the outer surface 46. It will be appreciated that the spacings between adjacent connector fittings, for example 100A and 104A, or 100B and 100C, are approximately equal.

While male connector fittings 100A-100C are shown on the outer surface 46 of base plate 42, male connector fittings 100A-100C could, instead, be female connector fittings provided that the component to which the outer surface of base plate is to be removably attached has the appropriate mating connector fitting thereon. Similarly, as discussed throughout the rest of this description, wherever a female connector fitting (or conversely male connector fitting) is mentioned, a male connector fitting (or conversely a female connector fitting) can be employed in its stead as long as complementary connector fittings are present on components to be removably attached thereto. Additionally, while male connector fittings 100A-100C are substantially clover leaf in shape as shown in FIG. 2A, the male connector fittings discussed herein, as well as the female connector fittings, can be of any shape that provides removable attachment of two components with a secure connection when attached. Alternatively, the connector fittings throughout the building element 40 may be entirely formed as female connector fittings. In this embodiment, the adjacent building elements may be removably connected using bi-male connectors having opposing male connector fittings sized and configured to be received in the female connector fittings.

In the first connector fitting arrangement, a plurality of male and female connector fittings, which are disposed on the side wall flange sections and generally designated 100 and 104, respectively, as best shown in FIG. 2B, are also included for receiving cooperating base plate connector fittings of other like building elements aligned with and positioned below the building element 40. The plurality of connector fittings 100 and 104 are either formed from or connected to the side wall flange sections 70, 72, 74, and 76, and face in the direction opposite the male connector fittings of the base plate flange sections. In the embodiment shown in FIG. 2B, female connector fittings 104D are formed out of the side wall flange sections 70, 72, 74, and 76 in a cooperating configuration and orientation as the male connector fittings 100A (FIG. 2A) that are disposed at the corners of the outer surface of the base plate. In addition, pairs of female fittings 104E and 104F are formed out of the side wall flange sections 70, 72, 74, and 76 in a cooperating configuration and orientation as the respective pair of male fittings 100B and 100C (FIG. 2A), which are disposed on the outer surface of the base plate. The first connector fitting arrangement further includes male connector fittings 100D and 100E formed out of the side wall flange sections 70, 72, 74, and 76 in a cooperating configuration and orientation as the respective female connector fittings 104A and 104B (FIG. 2A), which are disposed through the flange sections of the base plate. The cooperating male connector fittings and female connector fittings on the base plate flange sections and the side wall flange sections are configured to allow for secure, removable vertical stacking of a plurality of building elements 40, in order to vary the height of the modular substructure or foundation, if desired.

In the vertical stacking configuration, the female connector fittings 104C do not receive cooperating connector fittings, and thus, may be omitted, if desired. However, connector fittings 104C may be used in conjunction with or operate as a part of a third connector fitting arrangement for removably securing model set components thereto, which will be described in more detail below.

Figure 5A:
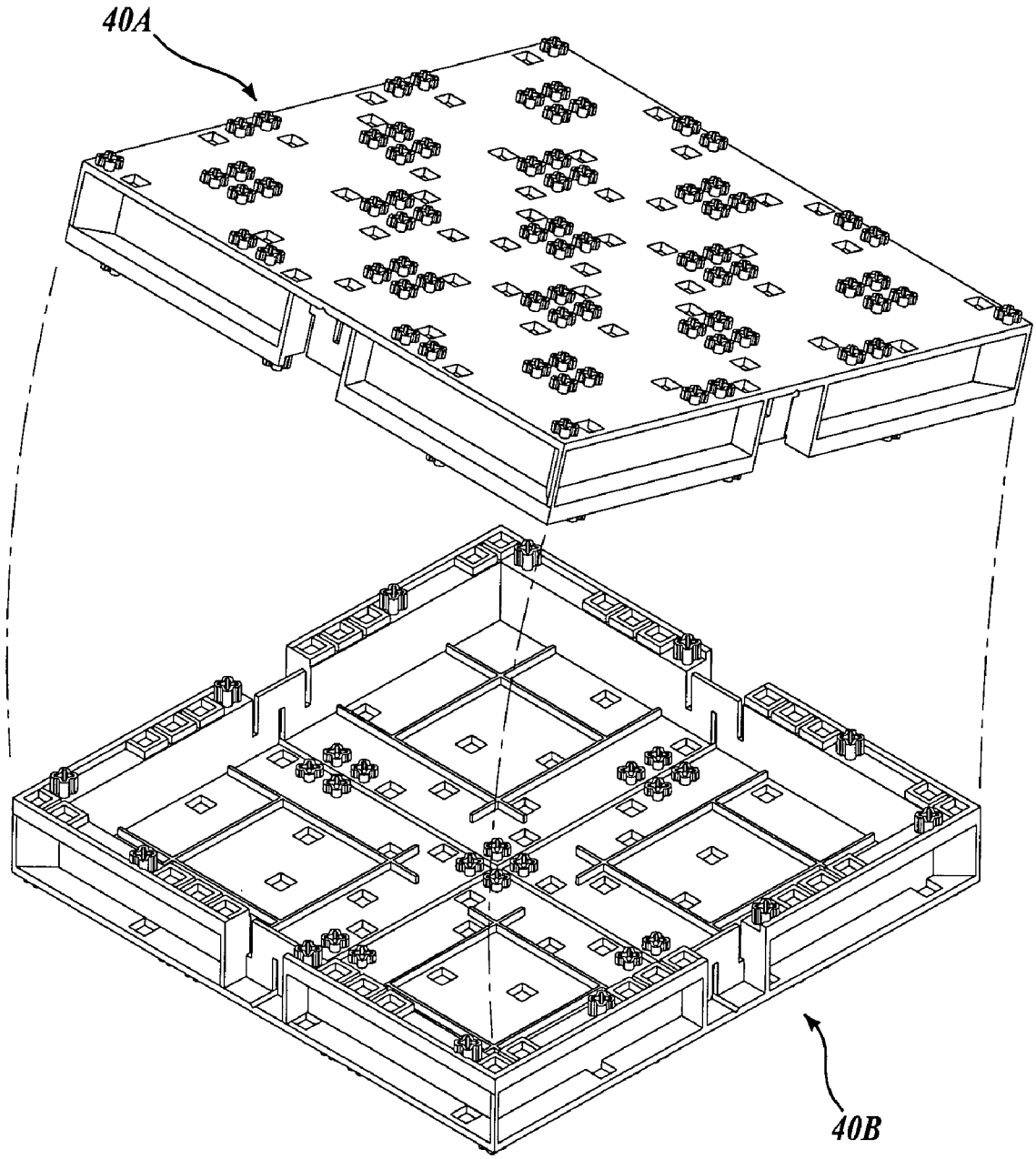
FIGS. 5A and 5B are perspective views of two building elements depicting an inverse vertical stacking configuration in accordance with the present invention.
Figure 5B:
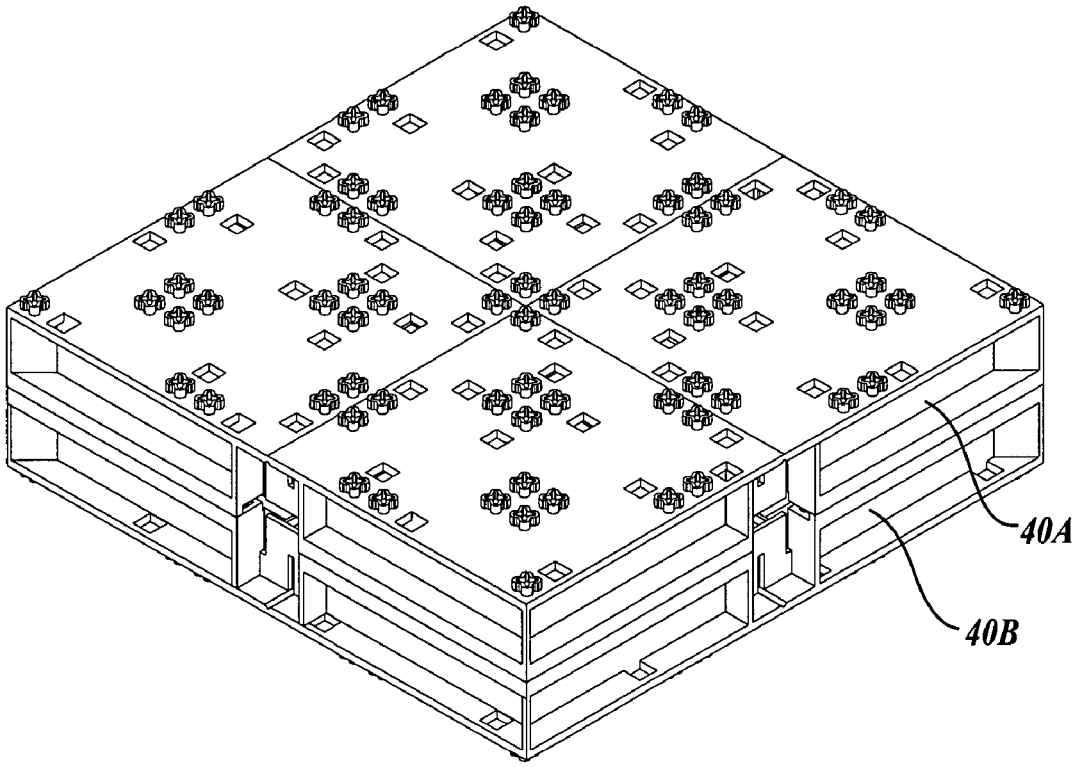

FIGS. 5A and 5B are perspective views of two building elements 40A and 40B depicting an inverse vertical stacking configuration in accordance with the present invention, where the building element 40B is inverted such that its side wall flange sections are juxtaposed with the side wall flange sections of the other building element 40A. In order to be removably secured in the inverse vertical stacking configuration, the building element 40 may include male and female connector fittings in a second connector fitting arrangement, which will now be described in detail. Returning now to FIGS. 2A and 2B, in addition to including the male and female connector fittings of the first connector fitting arrangement, the building element 40 may further include additional female connector fittings 110A and 110B formed out of the side wall flange sections 70, 72, 74, and 76, adjacent the female connector fittings 104E and 104D, respectively. It will be appreciated that female connector fittings 110A and 110B are sized and configured substantially identical to female fittings 104E and 104D, as well as being evenly spaced from and aligned with the female fittings 104E and 104D. The female connector fittings 110A and 110B cooperate with male connector fittings 100E and 100D, respectively, to allow for secure, removable coupling of two building elements in the position shown in FIG. 5B, for such applications as storing or shipping playing components 30 (see FIG. 1). Thus, the additional female connector fittings 110A and 110B, along with the connector fittings of the first connector fitting arrangement, comprise the second connector fitting arrangement.

In the inverse vertical stacking configuration, the female connector fittings 104D, 104E, and 104F do not receive cooperating connector fittings, and thus, may be omitted from the second connector fitting arrangement, if desired. However, connector fittings 104D, 104E, and 104F may be used in conjunction with or operate as a part of the first connector fitting arrangement, as was described in detail above.

Figure 3A:
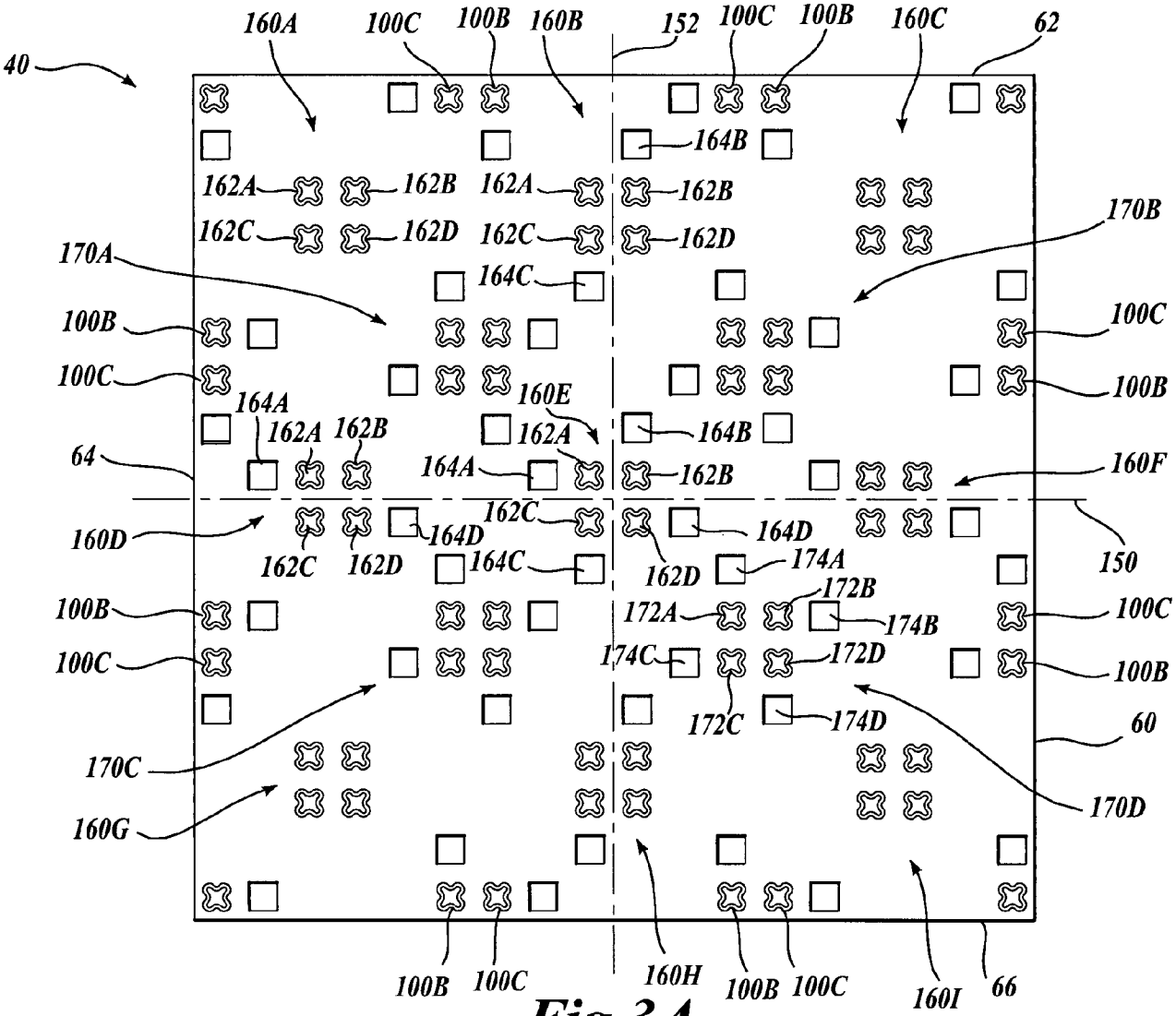
FIGS. 3A and 3B are top and bottom views, respectively, of the building element of FIGS. 2A and 2B.
Figure 6A:
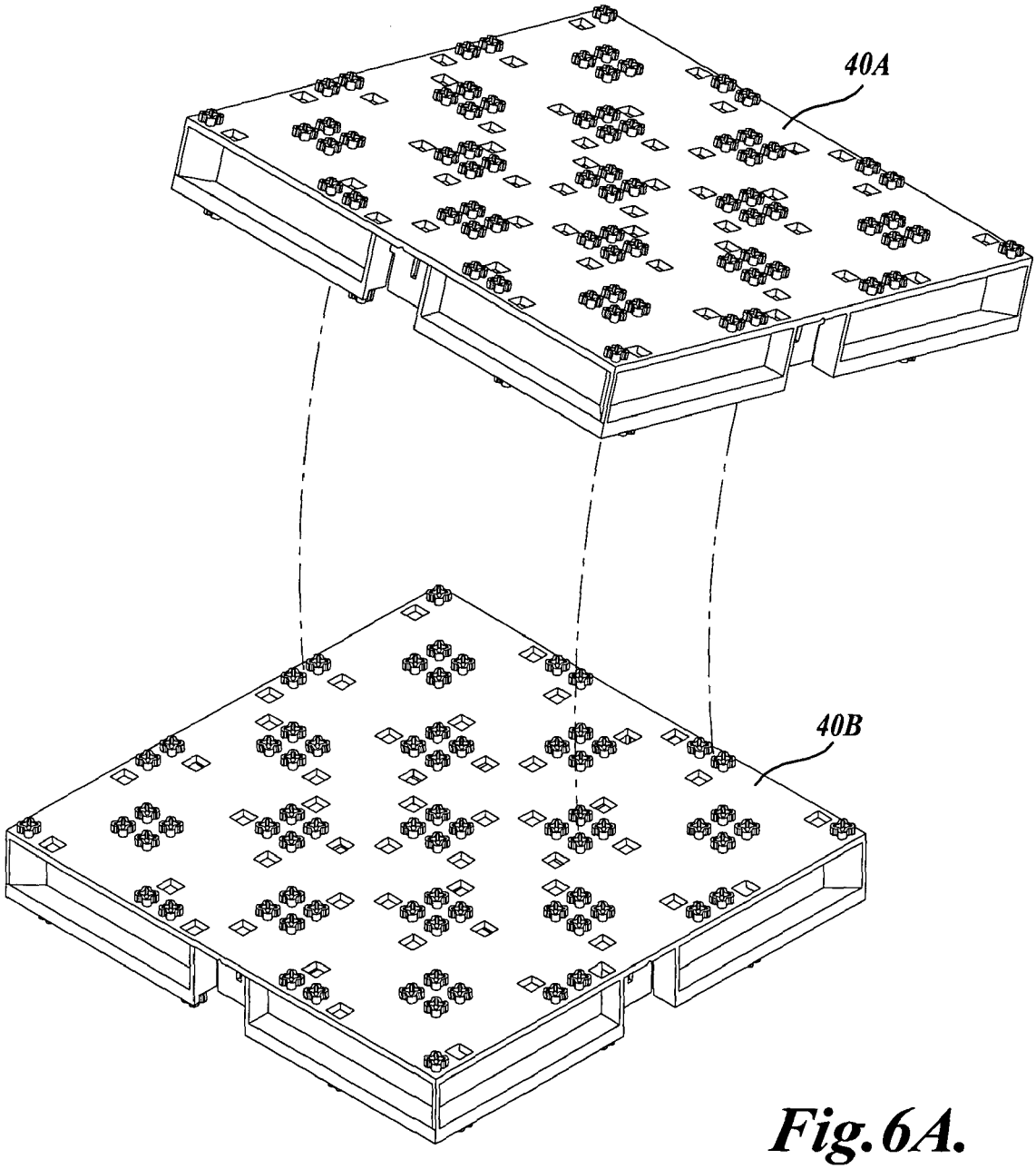
FIGS. 6A and 6B are perspective views of two building elements depicting a vertical offset stacking configuration in accordance with the present invention.
Figure 6B:
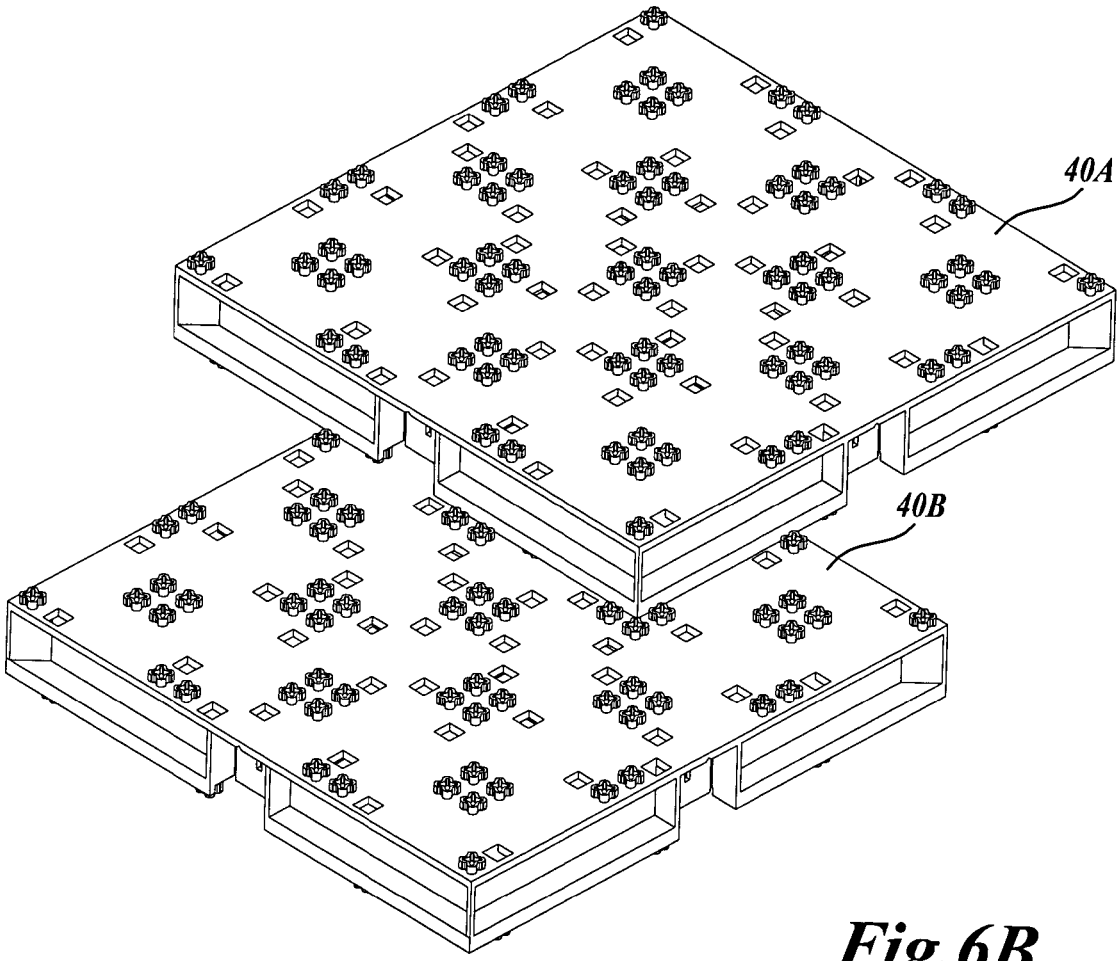

In accordance with another embodiment of the present invention, the building element 40 may further include a third connector fitting arrangement located on the outer surface 46 of the base plate 42 to enable the building element 40 to be removably secured at its outer surface 46 to other components of the model building set, such as terrain 28 (see FIG. 1), or to portions of the first connector fittings of another building element 40A in a vertical offset stacking configuration, as best shown in FIGS. 6A and 6B. Turning now to FIG. 3A, the third connector fitting arrangement is composed of a plurality of connector fitting clusters 160A-160I, which may or may not include female connector fittings. Each cluster 160A-160I is shown to include four male connector fittings 162A-162D (only clusters 160A, 160B, 160D, and 160E are numbered for ease of illustration) arranged in the shape of a square and located inward from the base plate flange sections 60, 62, 64, and 66. The clusters 160A-160I are arranged in three rows of three columns in the form of a 3×3 array, thereby forming four equal quadrants. The center row of clusters 160D, 160E, and 160F, and center column of clusters 160B, 160E, and 160H are positioned such that they are bisected by lateral planes 150 and 152, respectively, of the building element 40.

The center cluster 160E includes four female connector fittings 164A-164D, while clusters 160D and 160F include two female fittings 164A and 164D and clusters 160B and 160H include two female fittings 164B and 164C. The four female connector fittings 164A-164D are located adjacent to male connector fittings 162A-162D, opposite male fittings 162B, 162D, 162A, and 162C, respectively. The two female connector fittings 164A and 164D of clusters 160D and 160F are located adjacent to male connector fittings 162A and 162D, opposite male connector fittings 162B and 162C, respectively, while the two female connector fittings 164B and 164C of clusters 160B and 160H are located adjacent to male connector fittings 162B and 162C, opposite male connector fittings 162D and 162A, respectively.

The third connector fitting arrangement further includes four substantially identical clusters 170A-170D of connector fittings centrally positioned within the four quadrants and aligned with the pairs of male connector fittings 100B and 100C of the base plate flange sections 60, 62, 64, and 66. Each cluster 170A-170D includes four male connector fittings 172A-172D (only male connector fittings of cluster 170D are numbered for ease of illustration) arranged in the shape of a square. The clusters 170A-170D further include four female connector fittings 174A-174D (only female connector fittings of cluster 170D are numbered for ease of illustration) positioned adjacent to the male connector fittings 172A-172D, opposite male fittings 172C, 172A, 172D, 172B, respectively. While the connector fitting clusters 160A-160I and 170A-170D are arranged as shown, it will be appreciated that other arrangements may be practiced with, and are contemplated to be within the scope of, the present invention.

In accordance with another aspect of the present invention, the building elements 40 may be broken or separated into individual half-sections 200 and quarter-sections 202, as shown in FIGS. 8A-8E. In one embodiment, the half-sections 200 and the quarter-sections 202 may be utilized along with a plurality of building elements 40 to form substantially rigid foundation trusses, as will be described in more detail below.

Figure 3B:
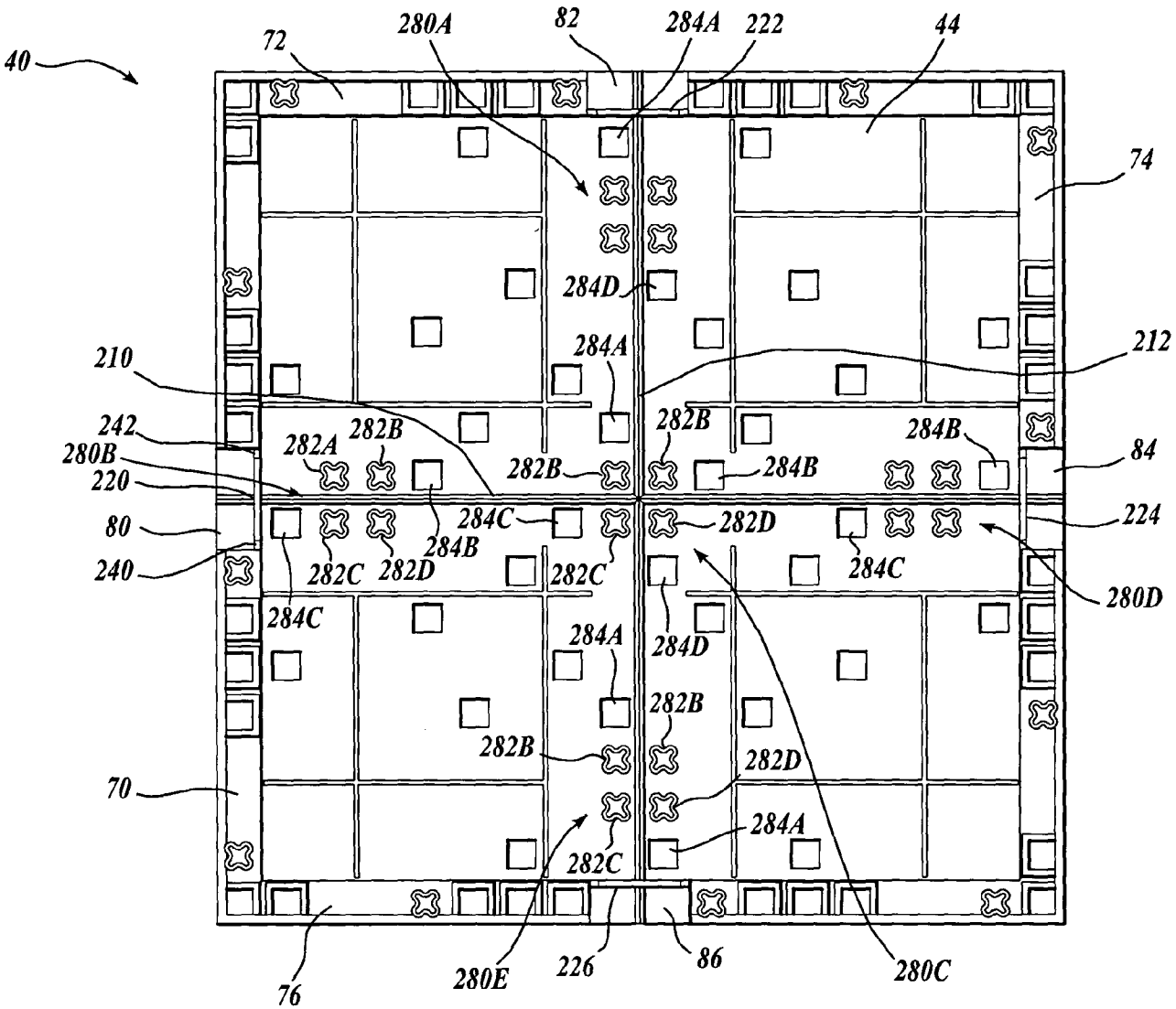

To permit the building element 40 to be separated or broken into half-sections 200 and quarter-sections 202, the building element 40 includes first and second sets of joints capable of decoupling shown as first and second score lines 210 and 212 and tabs 220, 222, 224, and 226, respectively, which will now be described in greater detail with reference to FIGS. 2B and 3B. As best shown in FIGS. 2B and 3B, first and second score lines 210 and 212 are configured as elongated grooves formed in the inner surface 44 of the base plate 42. The score lines 210 and 212 are oriented such that they are perpendicular to one another and bisect the base plate 42, as best shown in FIG. 3B. The score lines 210 and 212 are configured such that the building element 40 can be broken into either half-sections or quarter-sections by applying a bending moment about the score lines 210 and 212.

While score lines 210 and 212 are shown and described, other methods of providing a linear area of reduced strength, such as perforations, may be employed by embodiments of the present invention. Additionally, other joints capable of decoupling may be practiced with the present invention. For example, connector fittings of the type shown herein or others known in the art may be used to removably secure the quarter-sections and half-sections together to form the building element.

Figure 7:
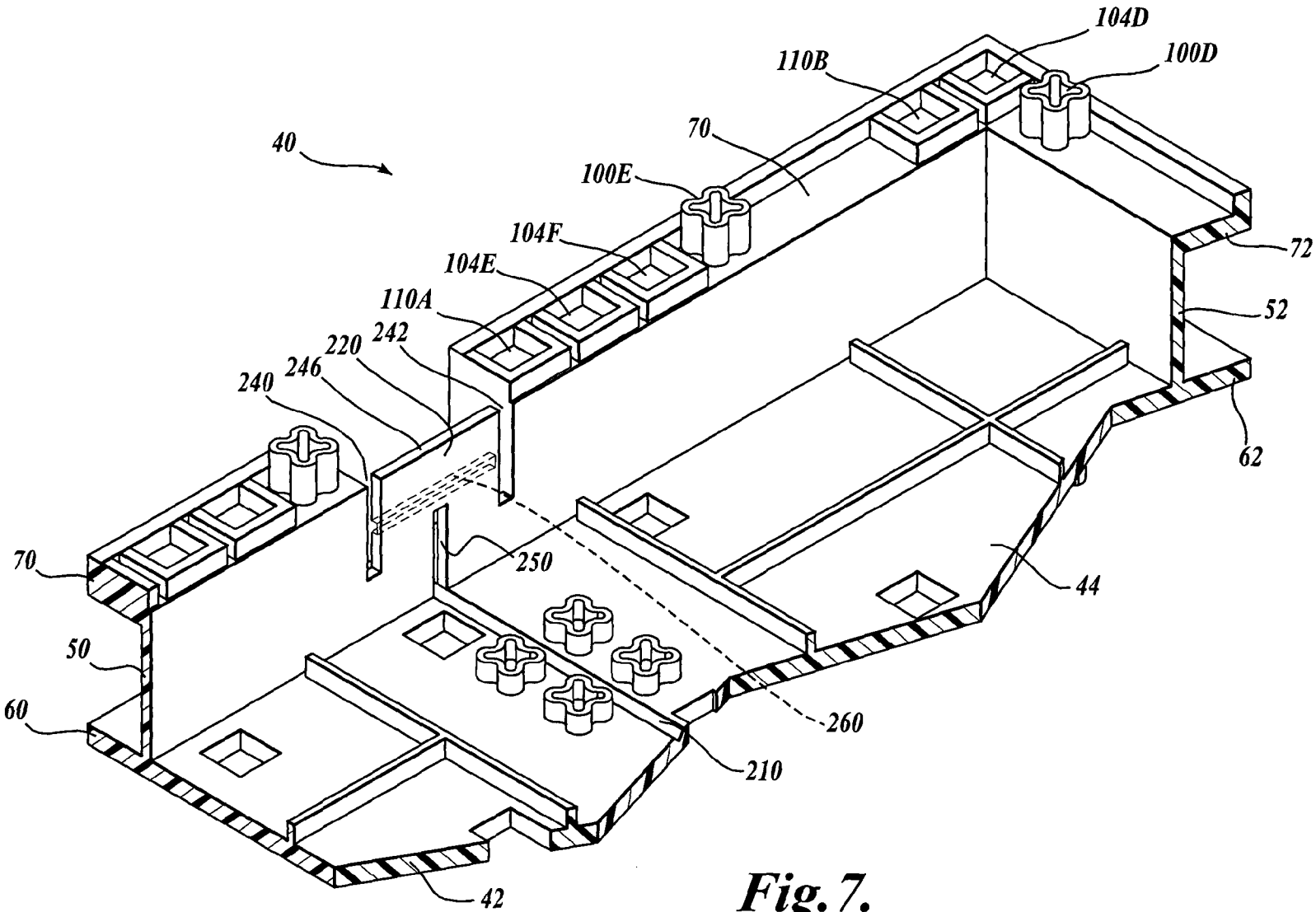
FIG. 7 is a partial perspective view of one side wall of the building element of FIG. 2B.

In addition to first and second score lines 210 and 212, the building element 40 includes a set of second joints capable of decoupling in the form of tabs 220, 222, 224, and 226 located adjacent the gaps 80, 82, 84, and 86 formed by the inner side edges of the side wall flange sections 70, 72, 74, and 76, respectively. Since each side wall is substantially identical in constructed, only one side wall will be described in detail. Turning now to FIG. 7, there is shown a partial perspective view of the building element 40 depicting side wall 50 forming a tab 220. The tab 220 is formed by first and second slots 240 and 242, which are spaced apart and positioned adjacent the side edges of the side wall flange section 70. The slots 240 and 242 extend parallel to one another from the outer edge 246 of the side wall 50 to a position in-between the mid-height of the side wall 50 and the intersection of the base plate inner surface 44 and the side wall 50.

A third slot 250 is formed through the side wall 50 and extends from the intersection of the base plate inner surface 44 and the side wall 50, aligned with the score line 210, to a position past the mid-height of the side wall 50. In the embodiment shown, the third slot 250 is centered in-between and oriented parallel with the first and second slots 210 and 212. A third score line 260, configured as a groove, is formed in the outer surface of the tab 220. The score line 260 interconnects the first and second slots 240 and 242 and runs parallel to the base plate flange 60, across the upper end of the third slot 250. As such, the tab 220 is a cantilevered structure that may be broken by bending the tab about score line 260.

Figure 8A:
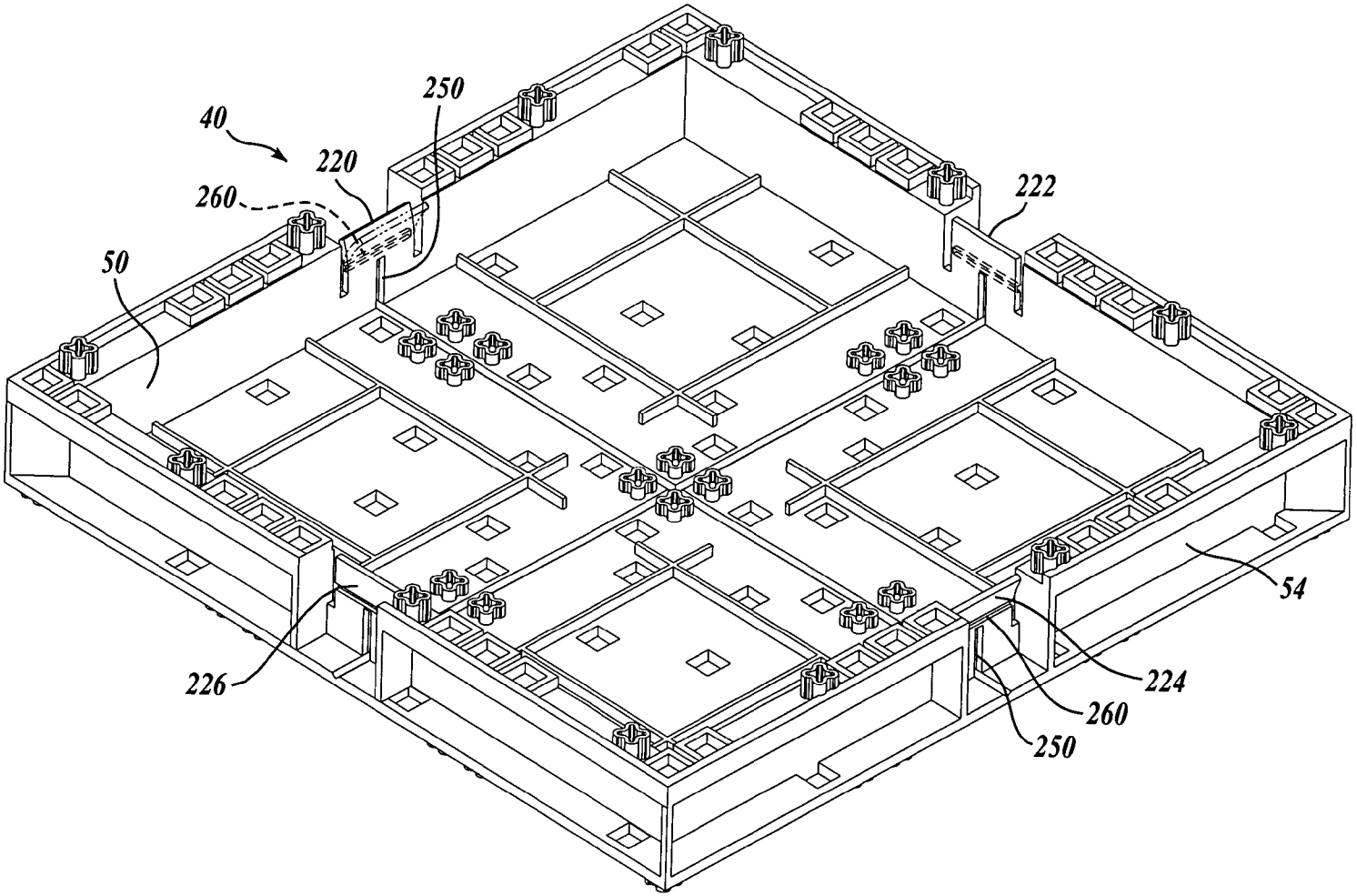
FIGS. 8A-8E are sequential perspective views depicting the separation of one building element first into two substantially identical half-sections, and next into substantially identical quarter-sections.
Figure 8B:
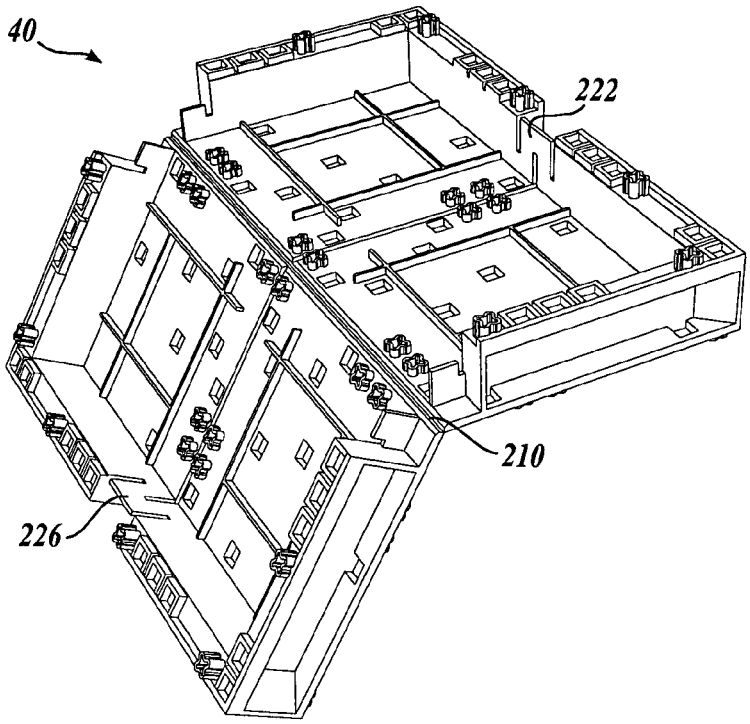
Figure 8C:
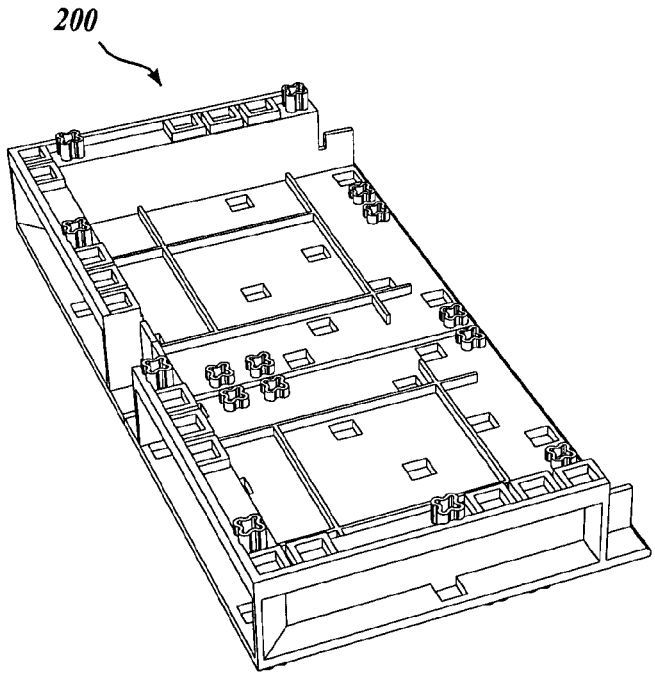
Figure 8D:
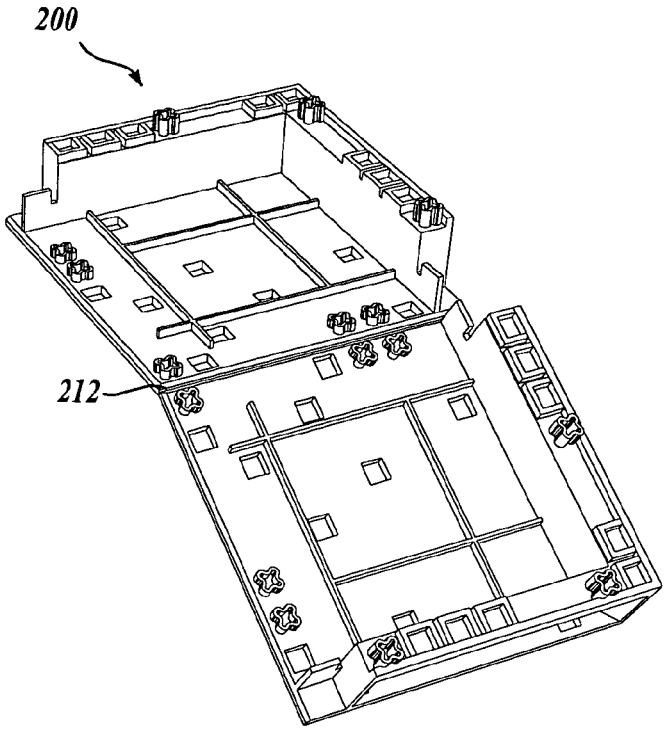
Figure 8E:
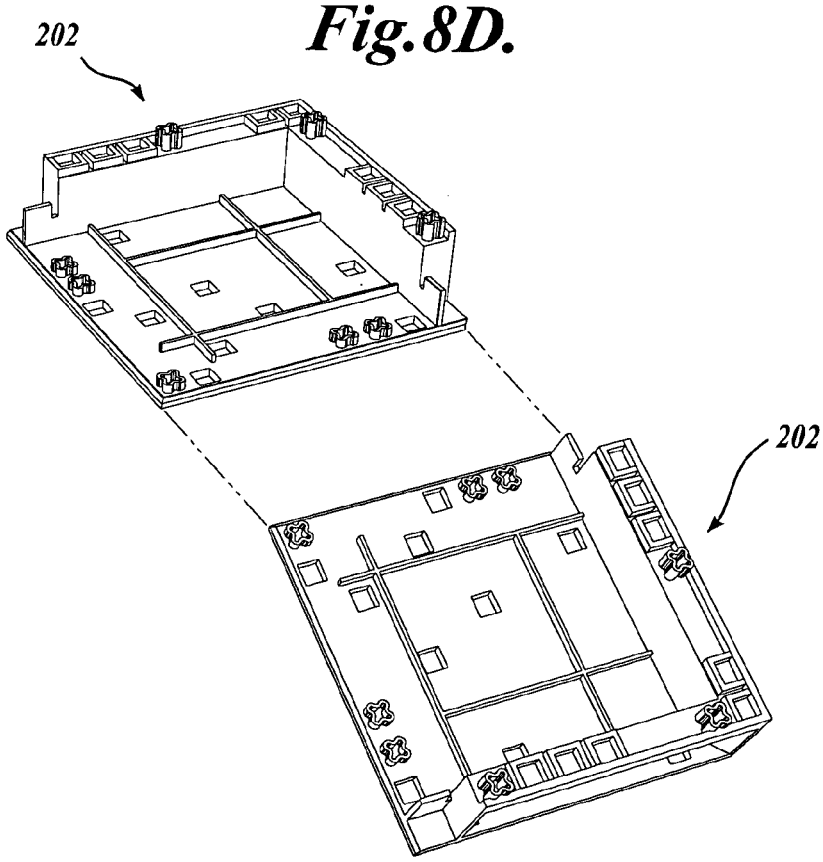

To break the building element into half-sections, tabs 220 and 224 or 222 and 226 on opposite side walls, i.e., 50, 54, or 52, 56, are broken or fractured, for example, by bending the tabs 220, 224 about the score lines 260, as shown best in FIG. 8A, thereby severing or decoupling the middle section of the side walls 50 and 54 due to the presence of the third slot 250. Then, to separate or break apart the building element 40 into half-sections 200, the building element may, for example, be bent or folded in half, as best shown in FIG. 8B, repeatedly if necessary, about the appropriate score line (i.e., score lines 210) that runs between the broken tabs until the building element 40 is divided into two separate half-sections (only one being shown in FIG. 8C). To further separate or break apart the half-sections 200 into quarter-sections 202, the remaining tabs of each half-section 200 may, for example, be broken in the same way as described above, and the half-sections 200 may, for example, be bent about the remaining score line (shown as reference number 212 in FIG. 8D), repeatedly if necessary, to break apart the half-sections 200 along the score line into quarter-sections 202, as best shown in FIG. 8E. It will be appreciated that regardless of which score line 210 or 212 is used to break the building element 40 into half-sections 200, the resulting half-sections 200 are substantially identical. Likewise, the quarter-sections 202 formed by breaking apart the resulting half-sections 200 are substantially identical.

As briefly described above, in accordance with one embodiment of the present invention, the half-sections 200 and quarter-sections 202 may be utilized with other building elements 40 to construct a substantially rigid foundation truss for such applications as supporting modular model building sets. To that end, the building element 40 includes a fourth connector fitting arrangement, which will now be described in detail. Turning now to FIGS. 3B, the fourth connector fitting arrangement includes the connector fittings of the first connector fitting arrangement that are formed out of the side wall flange sections 70, 72, 74, 76. The fourth connector fitting arrangement further includes a plurality, shown as five, connector fitting clusters 280A-280E disposed on the inner surface 44 of the base plate for cooperating with connector fittings of other half-sections or quarter-sections, as will be described in detail below.

The center cluster 280C includes four male connector fittings 282A-282D arranged in a shape of a square and located such that the score lines 210 and 212 bisect the four male connector fittings 282A-282D. As such, the fittings 282A-282D of cluster 280C are aligned directly under fittings 162B, 162A, 162D, and 162C of cluster 160E (see FIG. 3A). The center cluster 280C further includes four female connector fittings 284A-284D positioned adjacent to the male connector fittings 282A-282D. The remaining clusters 280A, 280B, 280D, and 280E are evenly spaced from the center cluster 280C in the direction of side wall flange sections 72, 70, 74, and 76, respectively, and aligned with center cluster 280C.

The clusters 280A, 280B, 280D, and 280E also include four male connector fittings 282A-282D, which are likewise arranged in a shape of a square and located such that each cluster is bisected by one of the score lines 210 or 212. As such, the male connector fittings 282A-282D of the clusters 280A, 280B, 280D, and 280E are aligned directly under the male connector fittings 162B, 162A, 162D and 162C of clusters 160B, 160D, 160F, and 160H, respectively (see FIG. 3A). The clusters 280A and 280E further include female connector fittings 284A and 284D disposed adjacent to male connector fittings 282A and 282D, opposite male connector fittings 282C and 282B, respectively (only clusters 280C, 280D, and 280E are numbered for ease of illustration). The clusters 280B and 280D further include female connector fittings 284B and 284C disposed adjacent to male connector fittings 282B and 282C, opposite male connector fittings 282A and 282D, respectively (only clusters 280C, 280D, and 280E are numbered for ease of illustration).

In the embodiment shown, the female connector fittings 284 of the fourth connector fitting arrangement may double as the female connector fittings 164 since they extend through the base plate 42. Alternatively, depending on the thickness of the base plate, the female connector fittings 164 and 284 are formed separately in the outer and inner surfaces of the base plate, respectively.

It will be appreciated that in the fourth arrangement, the distance between the male connector fittings of center cluster 280C and the male connector fittings of lateral clusters 280A, 280B, 280D, 280E is equal to the distance between female fitting 104D and the pair of female fittings 104E, 104F disposed closest to the respective female fitting 104D. For example, the distance between male connector fitting 282C of center cluster 280C and the pair of male connector fittings 282A and 282C of cluster 280E is equal to the distance between female connector fittings 104D and the pair of female connector fittings 104E and 104F.

Figure 9A:
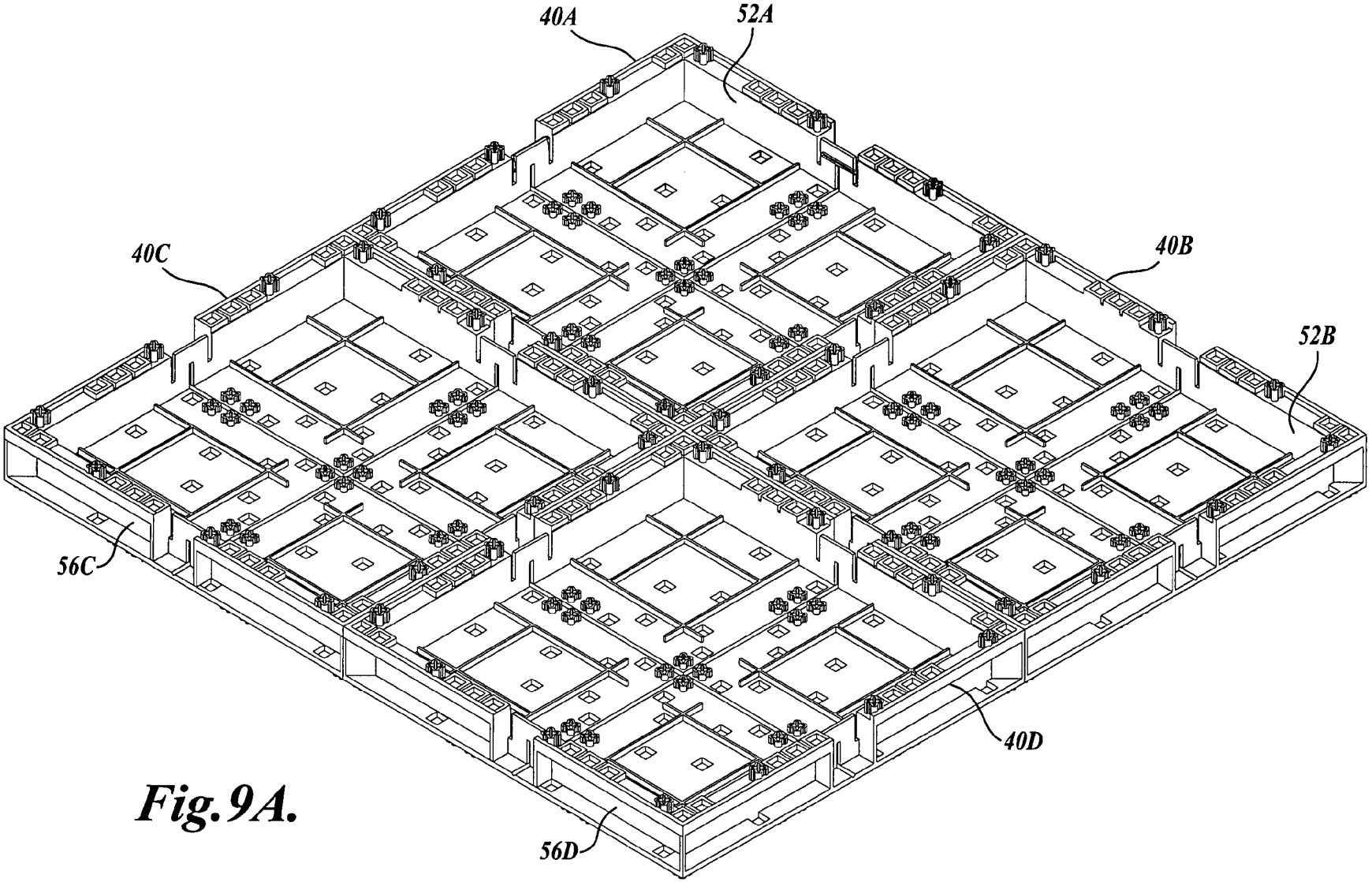
FIGS. 9A-9F are sequential perspective views depicting the construction of a substantially rigid foundation truss in accordance with one aspect of the present invention.

In accordance with aspects of the present invention, multiple building elements may be configured in the vertical stacking configuration, as shown best in FIG. 4A-4B, the inverse vertical stacking configuration, as shown best in FIG. 5A-5B, or may be arranged in a unique configuration known as an interlocking configuration for forming a substantially rigid foundation truss. One such interlocking configuration, which may be employed with the building elements, is shown in FIG. 9F. The interlocking configuration begins with four building elements 40A-40D arranged in abutting relationship in a 2×2 array and oriented such that their side walls face upward, as best shown in FIG. 9A. For clarity in the ensuing description, each building element 40A-40D is similarly oriented with side walls 52A and 52B of building elements 40A and 40B facing the upper right side of the page in FIG. 9A, while the side walls 56C and 56D of building elements 40C and 40D are facing the lower left side of the page.

Figure 9B:
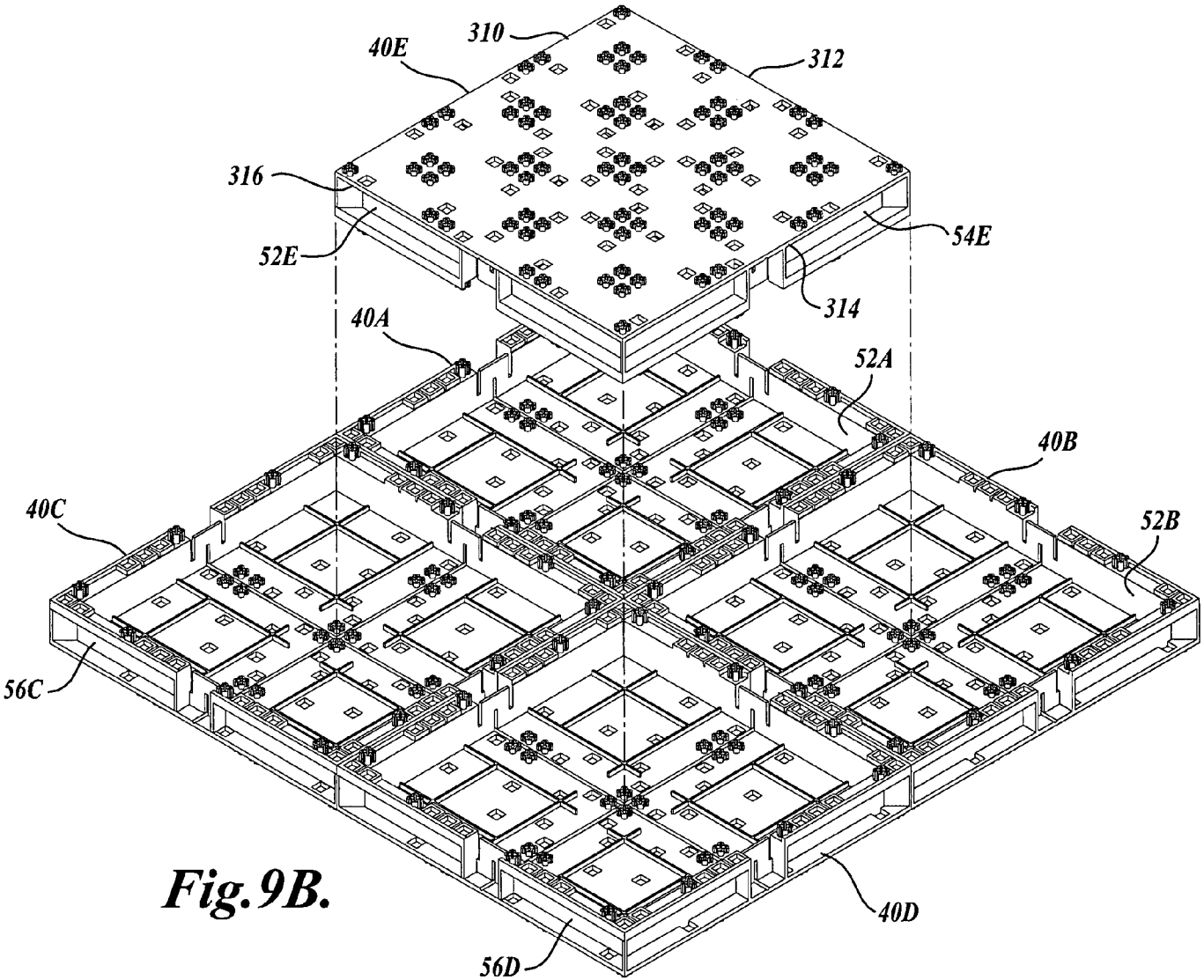

Next, a fifth building element 40E, oriented in an inverted manner (i.e., with its side walls facing downward) is aligned over the center of the 2×2 array, as shown in FIG. 9B, and lowered into engagement with the building elements 40A-40D of the 2 ×2 array, as shown in 9C. It will be appreciated by those skilled in the art that due to the arrangement of the connector fittings of building element 40E, the orientation of building element 40E (i.e. which side wall faces the upper right of the page in FIG. 9B) is inconsequential, and that the building element 40E can be rotated, clockwise or counter-clockwise, 90 or 180 degrees.

Figure 9C:
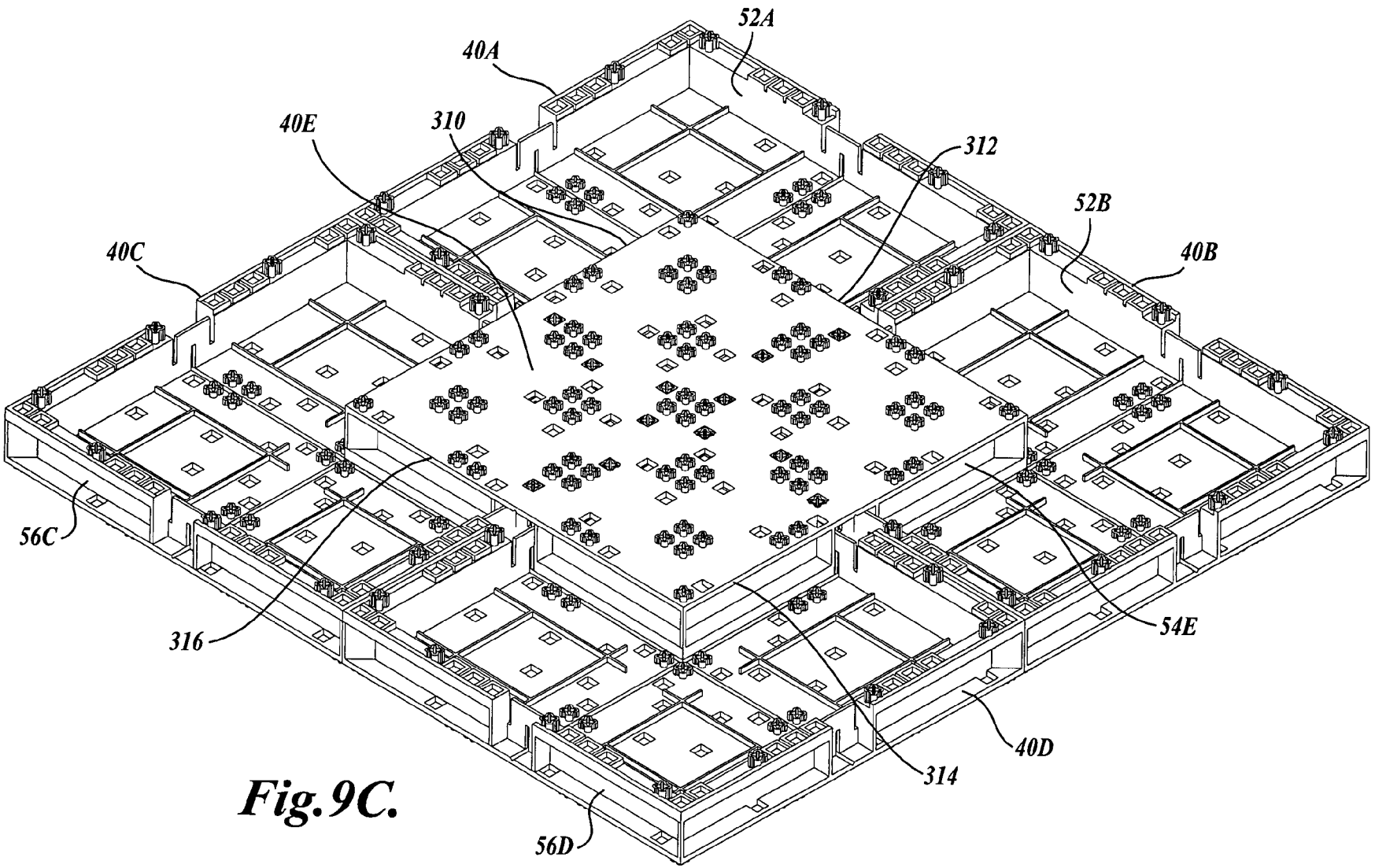

As the building element 40E is lowered from the position shown in FIG. 9B into the position shown in FIG. 9C, the following occurs: 1) the slots 240 and 242 (hidden in FIGS. 9B and 9C) disposed in the side walls of the building element 40E align with and slide into the slots 240 and 242 (hidden in FIG. 9C) of the cooperating building elements 40A-40D; and 2) the connector fittings disposed on the side wall end flanges of the building element 40E cooperatingly engage with aligned connector fittings located on the base plate inner surfaces of the building elements 40A-40D, while a portion of the connector fittings disposed on the side wall flange sections of the building elements 40A-40D cooperatingly engage with aligned connector fittings disposed on the base plate inner surface of building element 40E, to removably secure the building elements together in an interconnected manner. As such, it will be appreciated that the slots are spaced-apart a distance necessary for receiving side-by-side side walls of abutting building elements.

Figure 9D:
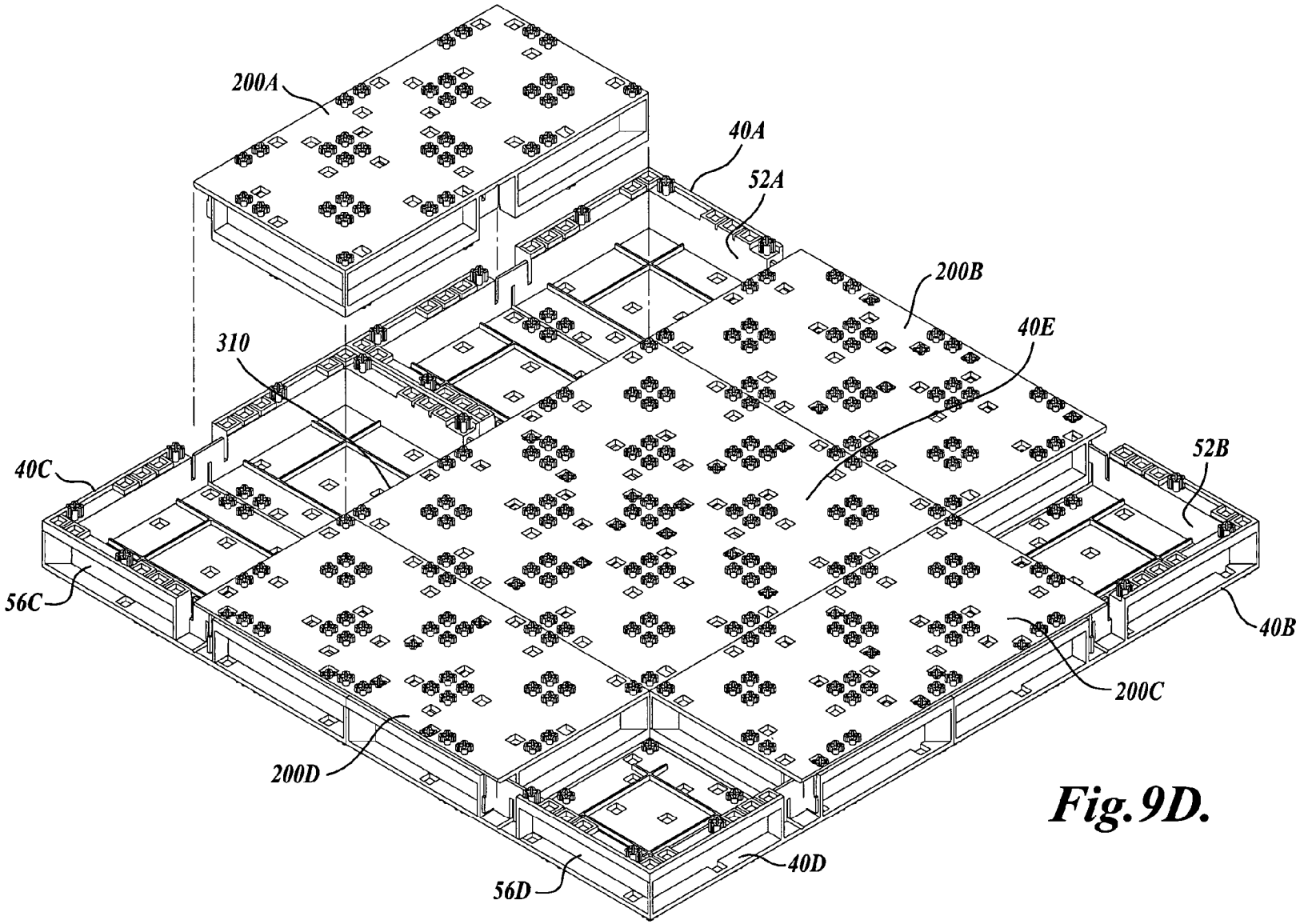

Continuing to form the interlocking configuration, four half-sections 200A-200D are obtained, for example, by dividing several extra building elements 40 in the manner discussed above. After four half-sections 200A-200D are obtained, they are lowered into position with their side walls facing downward and aligned to be adjacent or juxtaposed with the outer edges 310, 312, 314, and 316, respectively, of the building element 40E, as shown in FIG. 9D. As the half-sections 200A-200D are lowered into the position shown in FIG. 9D, the connector fittings disposed on the side wall flange sections of half-sections 200A-200D cooperatingly engage with aligned connector fittings disposed on the base plate inner surface of respective building elements 40A-40D, while a portion of the connector fittings disposed on the base plate inner surface of half-sections 200A-200D cooperatingly engage with aligned connector fittings disposed on the side wall flange sections of building elements 40A-40D, respectively. As such, the half-sections 200A-200D interconnect two adjacent building elements (e.g., 40A and 40B) of the first through fourth building elements 40A-40D. Alternatively, instead of four half-sections, any number of the half-sections may be separated into quarter-sections and used in a similar manner, although such a configuration would reduce the rigidity and strength of the resulting foundation truss.

Figure 9E:
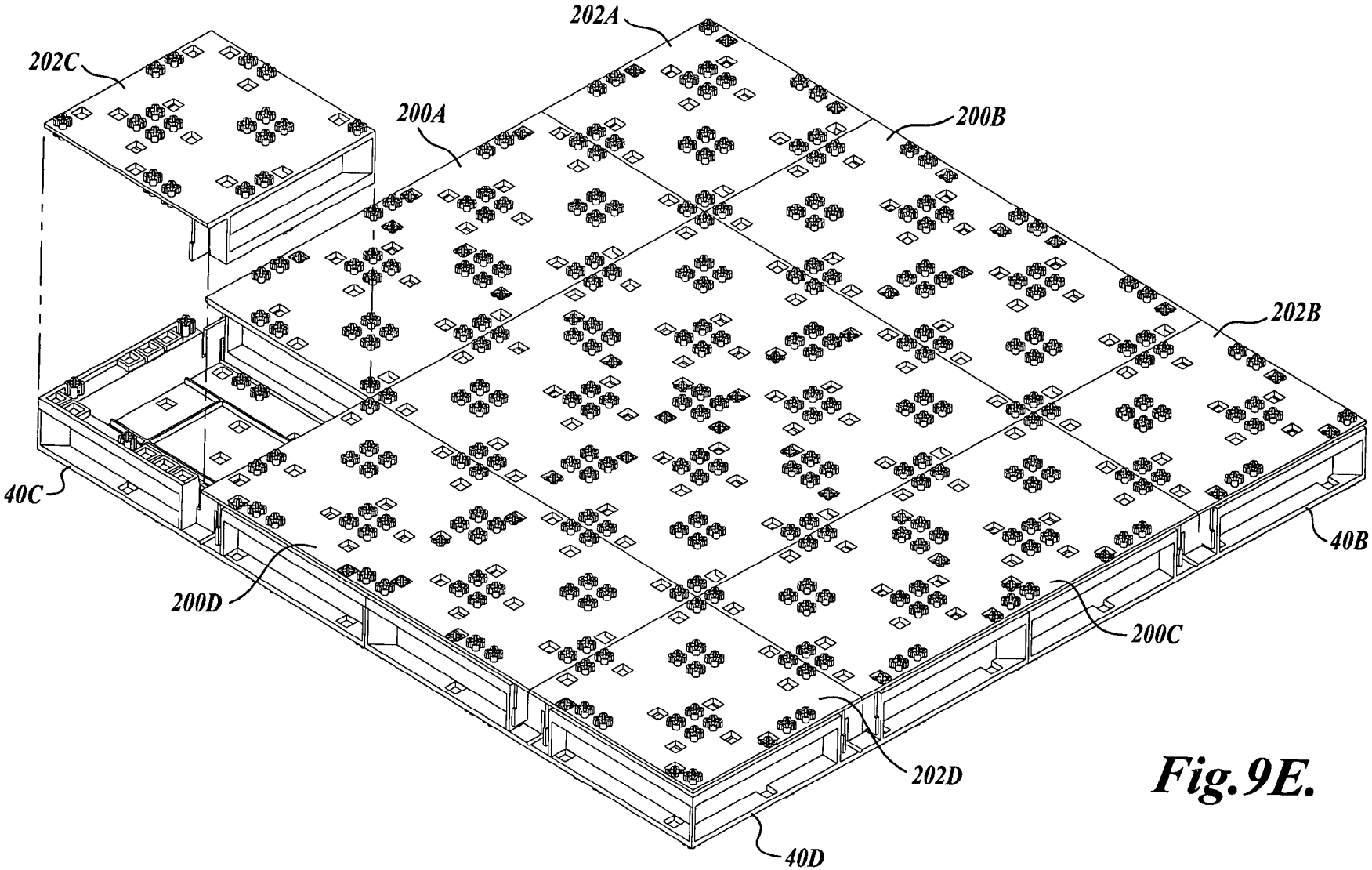
Figure 9F:
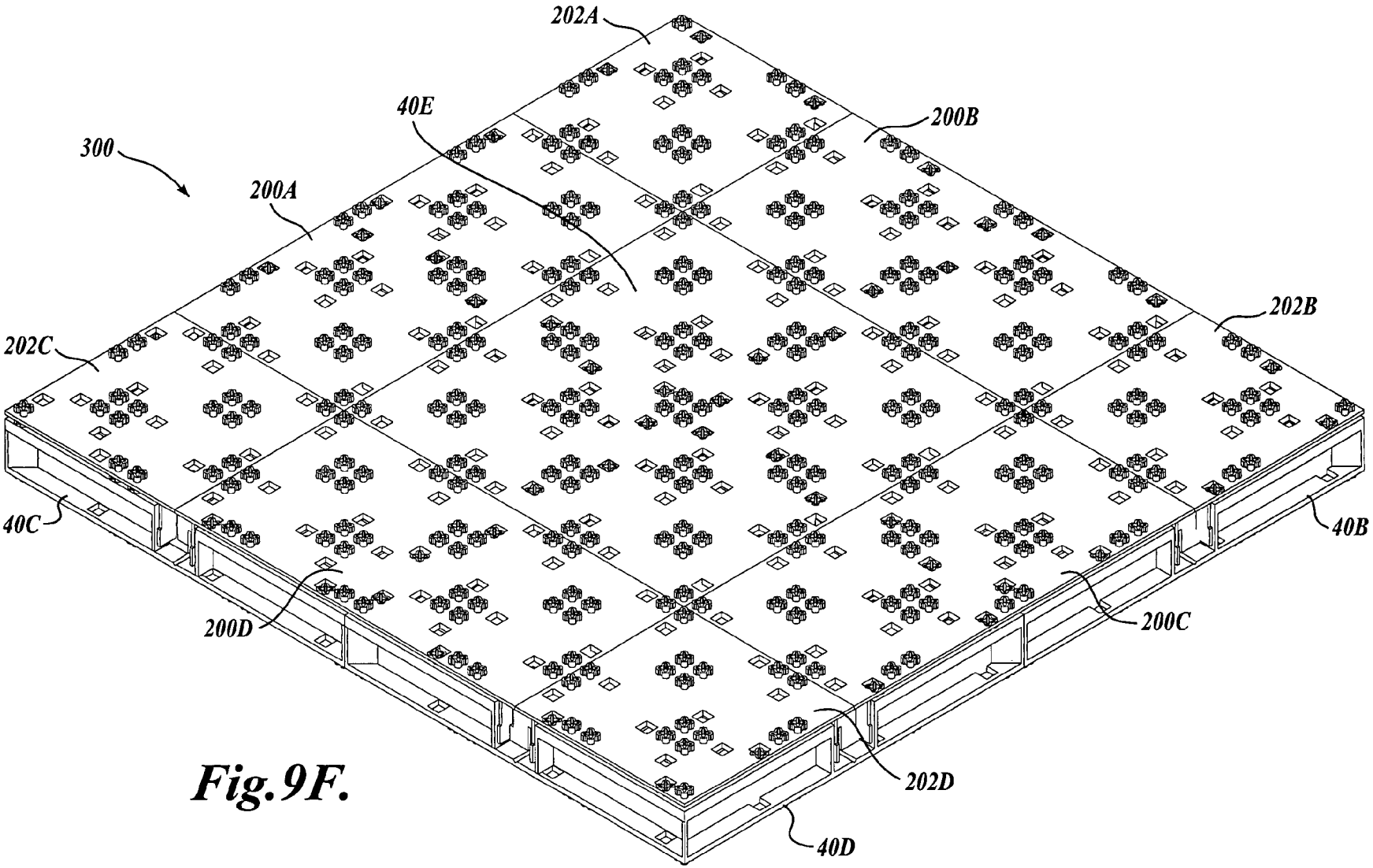

Next, four-quarter-sections 202A-202D are obtained in a manner described above to fill the void left in the interlocked configuration. To this end, the quarter-sections 202A-202D are lowered with their side walls facing downward and aligned to be adjacent or juxtaposed with the exposed side walls of the half-sections 200A-200D, into the position shown in FIG. 9E. As the quarter-sections 202A-202D are lowered into the position shown in FIG. 9E, the connector fittings disposed on the side wall flange sections of quarter-sections 202A-202D cooperatingly engage with the remaining aligned connector fittings disposed on the base plate inner surface of respective building elements 40A-40D, while a portion of the connector fittings disposed on the base plate inner surface of quarter-sections 202A-202D cooperatingly engage with aligned connector fittings disposed on the side wall flange sections of building elements 40A-40D, respectively. Once the quarter-sections 202A-202E are secured in place as shown in FIG. 9F, one embodiment of a foundation truss 300 is created, which is substantially rigid due to the interconnected building elements and sections.

Figure 10:
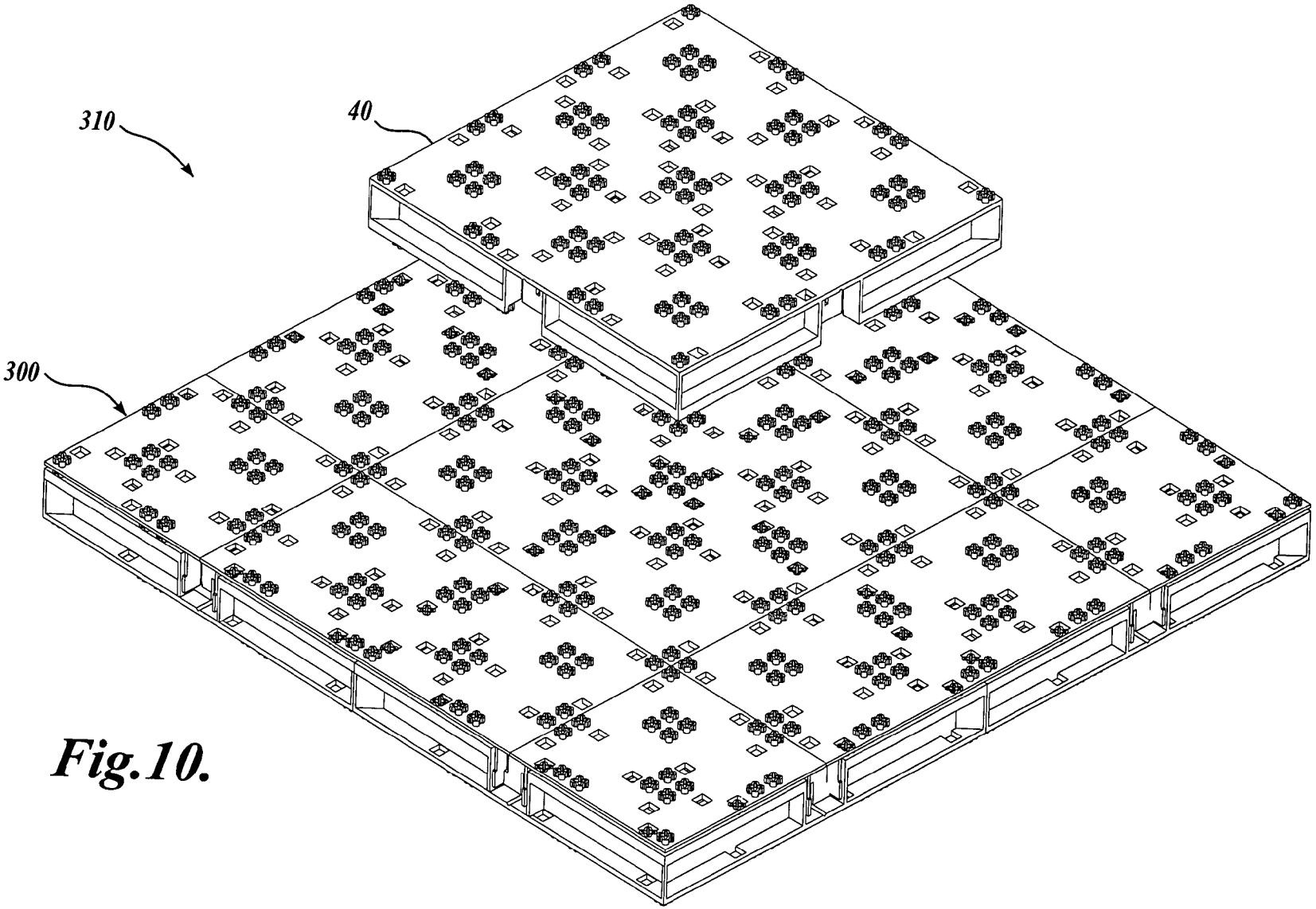
FIG. 10 is a perspective view of one modular substructure capable of being constructed utilizing the foundation truss of FIGS. 9A-9F.

It will be appreciated that another building element 40 may be attached to the top of the resulting foundation truss 300 in an offset manner for varying the height and topography of the substructure 310, as best shown in FIG. 10, or that the terrain 28 of FIG. 1 or other structures may be attached to the top of the resulting foundation truss 300, thereby enhancing the strength thereof. While the foundation truss 300 was shown and described as being interconnected by connector fittings, it will be appreciated that the connector fittings may be omitted, and that adhesive or the like may be utilized instead to interconnect the building elements. Additionally, it will be appreciated that the foundation truss 300 may be constructed with more or less building elements as described herein.

Figure 12:
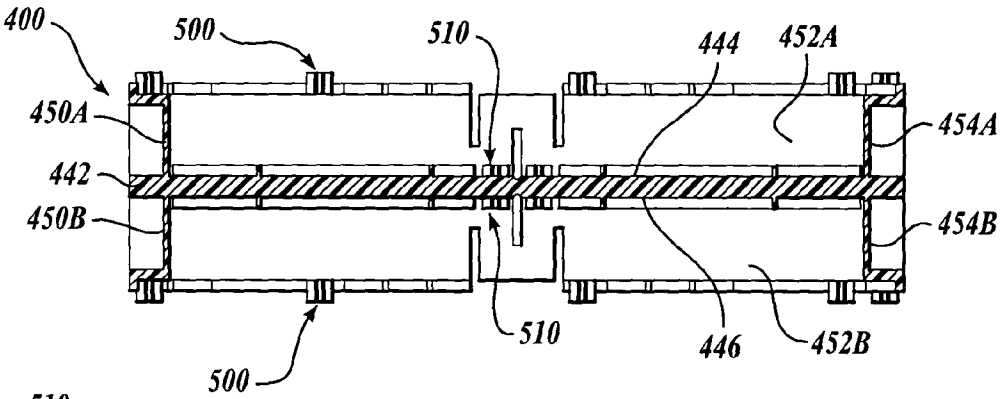
FIG. 12 is a cross-sectional view of the building element taken along lines 12-12 of FIG. 11.
Figure 11:
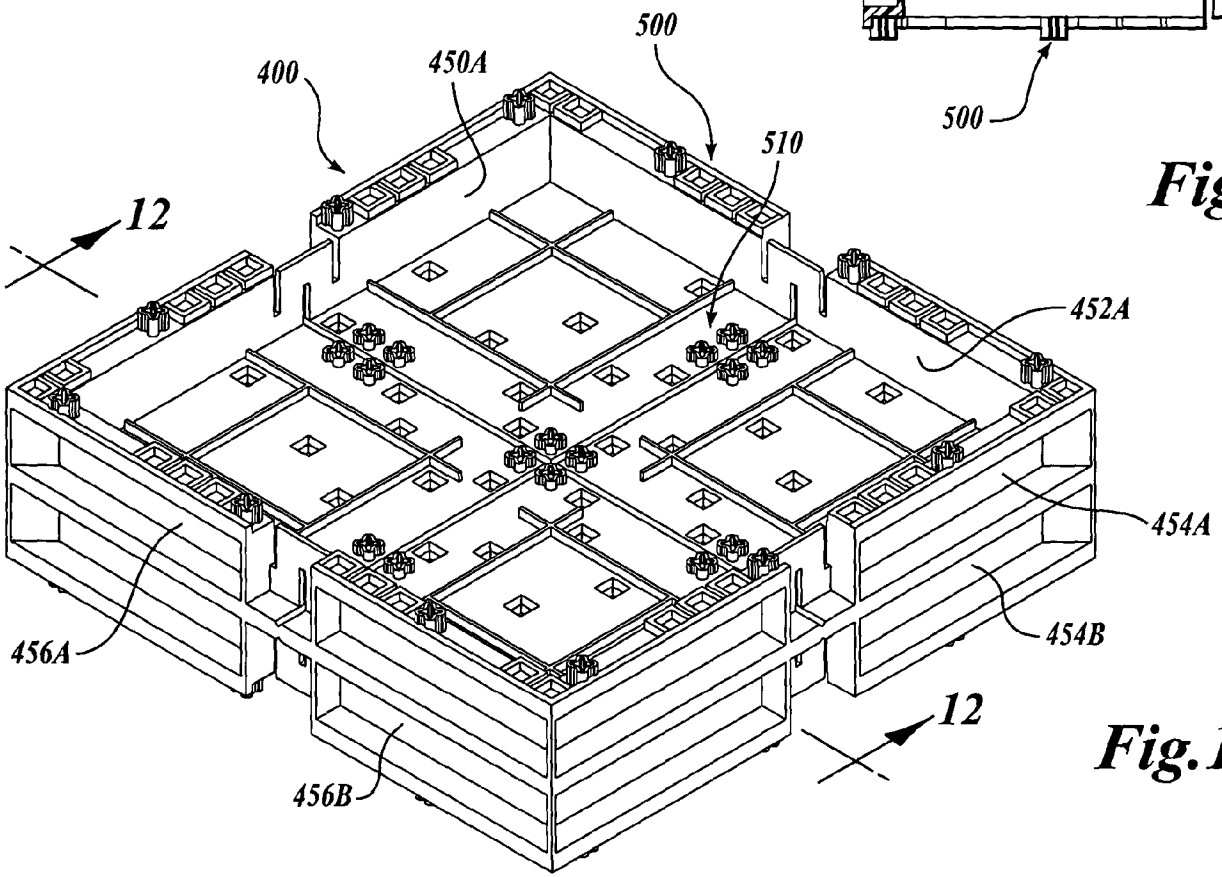
FIG. 11 is a perspective view of an alternative embodiment of the building element formed in accordance with the present invention.

While the building element 40 has been described above and shown herein in a box-like configuration having a base plate from which side walls extend in one direction therefrom, it will be appreciated that other configurations may be used. For example, in FIGS. 11 and 12, there is shown an alternative embodiment of a building element, generally designated 400. For clarity in the ensuing description, like elements will have like numeral beginning with the prefix "400." The building element 400 is substantially identical in construction to the building element 40 shown in FIGS. 2A-2B, except for the differences that will now be described. The building element 400 has an H-shaped cross-section shown best in FIG. 12 formed by polygonal shaped base section or plate 442, preferably square, having first and second planar surfaces 444 and 446, and side walls 450A-450B, 452A-452B, 454A-454B, and 456A-456B that extend orthogonally from the first and second planar surfaces 444 and 446, respectively, in opposite directions. The ends of side walls 450A-450B, 452A-452B, 454A-454B, and 456A-456B define connector fittings, generally designated 500, which may be configured and arranged as described above with respect to building element 40. The first and second planar surfaces 444 and 446 of the baseplate 442 may also include connector fittings, generally designated 510, which may be configured and arranged as described above with respect to inner planar surface 44 of building element 40.

While the exemplary embodiments of the invention have been illustrated and described, it will be appreciated that various changes can be made therein without departing from the spirit and scope of the invention, as claimed. For example, while the building element is shown as a rectangular configuration, shapes other the rectangular may be used that may be tessellated with other like building elements, such as triangular or pentagonal, to name a few. Additionally, it will be appreciated that the building elements described above and illustrated herein may be connected to other, non-identical building elements.

The embodiments of the invention in which an exclusive property or privilege is claimed are defined as follows:

1. A stackable building element adapted to be stacked in multiple-level configurations, the building element comprising:

a rectangular base plate having an inner surface and an outer surface;

a plurality of side walls extending outwardly substantially orthogonal from the inner surface of the base plate, the side walls having outer ends;

a plurality of first connector fittings positioned around the periphery of the base plate outer surface, the first connector fittings adapted to receive cooperating connector fittings of another building element; and a plurality of second connector fittings positioned at the side wall outer ends, the second connector fittings affanged and configured for cooperating with the first connector fittings of another building element;and positioned below and aligned therewith for allowing a secure, removable vertical stacking configuration of a plurality of building elements, wherein the plurality of second connector fittings are further arranged and configured for cooperating with second connector fittings of another building element positioned below, inverted such that the side wall outer ends of the building elements are juxtaposed, and aligned therewith for allowing a secure, removable inverted vertical stacking configuration of two building elements.

2. The building element of claim 1, wherein outwardly extending flanges are formed at the outer ends of the side walls, the flanges extending around the periphery of the building element, and wherein the second connector fittings are positioned on the flanges.

3. The building element of claim 1, wherein the first connector fittings include male connector fittings and female connector fittings.

4. the building element of claim 1, wherein the second connector fittings include male connector fittings and female connector fittings.

5. The building element of claim 1, further comprising a plurality of third connector fittings positioned on the outer surface of the base plate, spaced inward from the first connector fittings, wherein the third connector fittings are adapted to be removably secured to cooperating connector fittings of another structure.

6. The building element of claim 5, wherein the third connector fittings include male connector fittings and female connector fittings.

7. The building element of claim 1, wherein the building element is configured to be separable into individual half-sections.

8. The building element of claim 7, wherein the building element is configured such that the resulting half-sections are separable into individual quarter-sections.

9. A building element adapted to be separated into half-sections or quarter sections, the building element comprising:

a rectangular base plate having an inner and outer surfaces and lateral bisecting planes;

a plurality of side walls extending outwardly substantially orthogonal from the inner surface of the base plate, the side walls being contiguously connected and having outer ends;

a plurality of connector fittings positioned on the base plate outer surface and the side wall outer ends, the connector fittings adapted to be removably secured to cooperating connector fittings of another structure; and a set of first joints positioned along the lateral bisecting planes of the base plate, the joints configured for decoupling the base plate into separate sections;

wherein each side wall includes a second joint configured for decoupling each side wall into separate side wall sections.

10. The building element of claim 9, wherein the first joints are substantially linear areas of reduced strength that can be decoupled by applying a bending force thereabout.

11. The building element of claim 10, wherein the first joints are elongated grooves configured to decouple by applying a bending force thereabout.

12. The building element of claim 9, wherein the second joints are cantilevered tab structures that can be fractured, thereby decoupling each side wall into separate sections.

13. The building element of claim 9, wherein the set of first joints are first and second elongated grooves formed in the inner surface of the base plate, and wherein the first and second grooves are configured such that the base plate can be separated into separate sections along the first or second grooves.

14. The building element of claim 9, wherein the second joints are formed by first and second slots formed in each side wall and positioned on each side of the lateral bisecting planes, each slot extending from the outer end of the side wall into the side wall a selected distance, thereby forming a tab;

a plurality of grooves, each groove being formed in the outer surface of each side wall, the third grooves interconnecting the first and second slots; and a third slot positioned on each side wall, each third slot aligned with one of the bisecting planes, each third slot extending from the intersection of the base plate inner surface outward toward the outer end of the side walls and ending at the groove.

15. A building element adapted to be separated into half-sections or quarter sections, the building element comprising:

a rectangular base plate having inner and outer surfaces and lateral bisecting planes;

a plurality of side walls extending outwardly substantially orthogonal from the inner planar surface of the base plate, the side walls being contiguously connected and having outer ends;

a plurality of connector fittings positioned on the base plate outer surface and the side wall outer ends, the connector fittings adapted to be removably secured to cooperating connector fittings of another structure;

first means for decoupling the side walls at a location that is in substantial alignment with the bisecting planes of the building element; and second means for decoupling the base plate along its bisecting planes so that the building element may be separated into individual sections.

16. The building element of claim 15, wherein the base plate decoupling means includes first and second substantially linear areas of reduced strength.

17. The building element of claim 16, wherein the substantially linear areas of reduced strength are elongated grooves.

18. The building element of claim 17, wherein the base plate is separable by applying a bending force about the elongated grooves.

19. The building element of claim 15, wherein the side wall decoupling means is formed by a cantilevered structure centered about the lateral bisecting planes and a slot positioned through the side wall, each slot aligned with one of the bisecting planes and extending from the intersection of the base plate inner surface outward toward the outer end of the side walls through the cantilevered structure.

20. The building element of claim 15, wherein the side wall decoupling means includes first and second slots formed in each side wall and positioned on each side of the bisecting planes, each slot extending from the outer end of the side wall into the side wall a selected distance, thereby forming a tab structure;

a plurality of grooves, each groove being formed in the outer surface of each side wall, the grooves interconnecting the first and second slots; and a third slot positioned on each side wall, each third slot aligned with one of the bisecting planes, each third slot extending from the intersection of the base plate inner surface outward toward the outer end of the side walls and ending at the groove.

21. A modular substructure, comprising:

a first building element including a polygonal base having first and second opposed planar surfaces and a plurality of contiguously connected side walls extending outwardly from the first planar surface, thereby defining a first cavity;

a second building element including a polygonal base having first and second opposed planar surfaces and a plurality of contiguously connected side walls extending outwardly from the first planar surface, thereby defining a second cavity;

wherein a portion of the first building element is interconnected with a portion of the second building element such that the second planar surface of the first building element is substantially parallel to second planar surface of the second building element, at least one side wall of the first building element interfaces with at least one side wall of the second building element, and a section of the first building element occupies a portion of the second cavity and a section of the second building element occupies a portion of the first cavity.

22. the modular substructure of claim 21 wherein the first building element is substantially identical to the second building element.

23. The modular substructure of claim 21, wherein the first building element is removably connected to the second building element.

24. The modular substructure of claim 23, wherein the side walls of the first or second building element include connector fittings and the first planar surface of the second or first building element includes connector fittings that cooperate with the connector fittings of the first or second building element, respectively, for removably connecting the first building element to the second building element.

25. The modular substructure of claim 21, wherein the bases of the first and second building elements are rectangular.

26. The modular substructure of claim 21, further comprising a third building element including a polygonal base having first and second opposed planar surfaces and a plurality of contiguously connected side walls extending outwardly from the first planar surface, thereby defining a third cavity;

wherein a portion of the second building element is interconnected with a portion of the third building element such that the second planar surface of the second building element is substantially parallel to second planar surface of the third building element, at least one side wall of the second building element interfaces with at least one side wall of the third building element, and a section of the second building element occupies a portion of the third cavity and a section of the third building element occupies a portion of the second cavity.

27. A method of constructing an interconnected, modular substructure, compnsing:

obtaining first, second, third, fourth, and fifth substantially identical building elements, each building element including a rectangular base plate having inner and outer surfaces and lateral edges, a plurality of side walls extending outwardly substantially orthogonal from the inner surface of the base plate, the side walls having outer ends, a plurality of connector fittings disposed on the inner surface of the base plate and the side wall outer ends, wherein the building elements are configured so as to be separable into half-sections and quarter-sections each having a portion of the plurality of connector fittings;

arranging the first, second, third, and fourth substantially identical building elements in abutting relationship as a 2 ×2 array, each respective building element oriented so that the side walls of the building elements extend in the same direction; and placing the fifth building element in an inverted manner with respect to the first through fourth building element in the center of the 2 ×2 array so that at least one connector fitting of each of the first, second, third, and fourth building element cooperatively engage with at least one connector fitting of the fifth building element in a removably secure manner.

28. The method of claim 27, further comprising obtaining a sixth and seventh building element substantially similar to the first through fifth building elements;

obtaining at least four half section by separating the sixth and seventh building elements; and placing the obtained four half-sections in an inverted manner adjacent each lateral edge of the fifth building element, at least one connector fitting of each half section cooperatively engaging with at least one connector fitting of adjacent building elements of the 2 ×2 array in a removably secure manner.

29. The method of claim 28, further comprising obtaining an eighth building element substantially similar to the first through sixth building elements;

obtaining at least four quarter-section by separating the eight building element; and placing the obtained four quarter-sections in an inverted manner adjacent the exposed edges of the four half-sections, at least one connector fitting of each quarter-section cooperatively engaging with at least one connector fitting of the respective first, second, third, and fourth building element in a removably secure manner.

30. The method of claim 29, wherein the sixth, seventh, and eight building element include at least two joints aligned along the bisecting planes of the building element, the joints configured for decoupling the building element into separate sections, and wherein obtaining the half-sections includes decoupling the sixth and seventh building element along one the joints.

31. The method of claim 30, wherein decoupling the sixth and seventh building element includes bending the building element about one of the joints.

32. The method of claim 30, wherein obtaining the quarter-sections includes decoupling the eighth building element into half-sections; and decoupling the resulting half-sections into quarter-sections.

33. The method of claim 32, wherein decoupling the eighth building element into half-sections includes bending the half-sections about one of the joints.

34. The method of claim 33, wherein decoupling the resulting half-sections into quarter-sections includes bending the half-sections about the other joint.

* * * * *

UNITED STATES PATENT AND TRADEMARK OFFICE

CERTIFICATE OF CORRECTION

PATENT NO. : 7,517,269 B2
APPLICATION NO. : 10/639606
DATED : April 14, 2009
INVENTOR(S) : P. Cyrus et al.

It is certified that error appears in the above-identified patent and that said Letters Patent is hereby corrected as shown below:

| COLUMN | LINE | ERROR |
|---|---|---|
| 12 | 63 | "affanged" should read --arranged-- |
| 12 | 64 | "element;and" should read --element-- |
| 16 | 16 | "half section" should read --half-section-- |
| 16 | 25 | a line break should follow "further comprising" |

Signed and Sealed this

Eighth Day of September, 2009

David J. Kappos

David J. Kappos
*Director of the United States Patent and Trademark Office*